US010932066B2

(12) United States Patent
Pedersen et al.

(10) Patent No.: US 10,932,066 B2
(45) Date of Patent: Feb. 23, 2021

(54) HEARING DEVICE COMPRISING A BEAMFORMER FILTERING UNIT FOR REDUCING FEEDBACK

(71) Applicant: Oticon A/S, Smørum (DK)

(72) Inventors: Michael Syskind Pedersen, Smørum (DK); Svend Oscar Petersen, Smørum (DK); Meng Guo, Smørum (DK); Karsten Bo Rasmussen, Smørum (DK); Troels Holm Pedersen, Smørum (DK); Kenneth Rueskov Møller, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/271,557

(22) Filed: Feb. 8, 2019

(65) Prior Publication Data

US 2019/0253813 A1 Aug. 15, 2019

(30) Foreign Application Priority Data

Feb. 9, 2018 (EP) ..... 18156196

(51) Int. Cl.
*H04R 25/00* (2006.01)

(52) U.S. Cl.
CPC ..... *H04R 25/453* (2013.01); *H04R 25/405* (2013.01); *H04R 25/407* (2013.01);
(Continued)

(58) Field of Classification Search
CPC .. H04R 25/453; H04R 25/652; H04R 25/604; H04R 25/405; H04R 25/407;
(Continued)

(56) References Cited

U.S. PATENT DOCUMENTS 6,072,884 A * 6/2000 Kates ..... H04R 25/453 381/318
9,800,981 B2 * 10/2017 Kuriger ..... H04R 25/407
(Continued)

FOREIGN PATENT DOCUMENTS

EP 2 701 145 A1 2/2014
EP 2 843 971 A1 3/2015
(Continued)

*Primary Examiner* — Oyesola C Ojo
(74) *Attorney, Agent, or Firm* — Birch, Stewart, Kolasch & Birch, LLP

(57) ABSTRACT

A hearing device, e.g. a hearing aid, comprises a) a multitude of input transducers for providing respective electric input signals representing sound in an environment of the user; b) an output transducer for providing stimuli perceivable to the user as sound based on said electric input signals or a processed version thereof; c) an adaptive beamformer filtering unit connected to said input unit and to said output unit, and configured to provide a spatially filtered signal based on said multitude of electric input signals and adaptively updated beamformer weights; and d) a feedback estimation unit providing feedback estimates of current feedback paths from said output transducer to each of said input transducers. The hearing device is configured to provide that at least one of said adaptively updated beamformer weights of the adaptive beamformer filtering unit is/are updated in dependence of said feedback path estimates. The application further relates to a method of suppressing feedback.

26 Claims, 10 Drawing Sheets

Basic principle: Two microphones spaced 7-8 millimeters apart
- signal processing optimized for cancellation of in-ear feedback

(52) U.S. Cl.
CPC ..... *H04R 25/604* (2013.01); *H04R 25/652* (2013.01); *H04R 25/554* (2013.01); *H04R 25/606* (2013.01); *H04R 2225/025* (2013.01); *H04R 2225/67* (2013.01); *H04R 2460/13* (2013.01)

(58) Field of Classification Search
CPC ..... H04R 25/606; H04R 2460/13; H04R 25/554; H04R 2225/67; H04R 2225/025; H04R 2225/51; H04R 25/00
See application file for complete search history.

(56) References Cited

U.S. PATENT DOCUMENTS

2007/0121978 A1* 5/2007 Jang ..... H04R 25/405 381/315
2007/0186418 A1* 8/2007 Meier ..... H04R 25/405 29/896.2
2009/0067651 A1* 3/2009 Klinkby ..... H04R 25/453 381/313
2009/0202091 A1* 8/2009 Pedersen ..... H04R 25/407 381/313
2010/0150385 A1* 6/2010 Sporer ..... H04R 25/652 381/313
2011/0255725 A1* 10/2011 Faltys ..... H04R 25/407 381/328
2013/0195297 A1* 8/2013 Burns ..... H04R 3/005 381/313
2014/0056435 A1* 2/2014 Kjems ..... H04M 9/082 381/66
2015/0078600 A1* 3/2015 Rasmussen ..... H04R 25/453 381/318
2017/0180878 A1* 6/2017 Petersen ..... H04R 25/453
2017/0180879 A1* 6/2017 Petersen ..... H04R 25/407
2017/0180882 A1* 6/2017 Lunner ..... G06F 3/013
2017/0347206 A1* 11/2017 Pedersen ..... H04R 3/007

FOREIGN PATENT DOCUMENTS

EP 3 101 919 A1 12/2016
EP 3 253 075 A1 12/2017

* cited by examiner

Basic principle: Two microphones spaced 7-8 millimeters apart
- signal processing optimized for cancellation of in-ear feedback

HEARING DEVICE COMPRISING A BEAMFORMER FILTERING UNIT FOR REDUCING FEEDBACK

SUMMARY

The present application relates to the field of hearing devices, e.g. hearing aids, in particular to feedback from an output transducer to an input transducer of the hearing device.

A Hearing Device:

In an aspect of the present application, a hearing device, e.g. a hearing aid, configured to be located at or in an ear, or to be fully or partially implanted in the head at an ear, of a user is provided. The hearing device comprises

- a multitude of input transducers for providing respective electric input signals representing sound in an environment of the user;
- an output transducer for providing stimuli perceivable to the user as sound based on said electric input signals or a processed version thereof;
- an adaptive beamformer filtering unit connected to said input unit and to said output unit, and configured to provide a spatially filtered signal based on said multitude of electric input signals and adaptively updated beamformer weights;
- a feedback estimation unit providing feedback estimates of current feedback paths from said output transducer to each of said input transducers.

The hearing device is configured to provide that at least one of said adaptively updated beamformer weights of the adaptive beamformer filtering unit is/are updated in dependence of said feedback path estimates.

Thereby a hearing device comprising an alternative feedback reduction system may be provided.

The multitude of input transducers may be or comprise a microphone. The beamformer filtering unit may constitute or comprise an MVDR beamformer (MVDR=Minimum Variance Distortionless Response. The term stimuli perceivable as sound is in the present context predominantly taken to mean stimuli that may cause feedback to an input transducer. When solely electric stimuli are applied (e.g. in a cochlear implant) feedback problems a not present, but in cases where a combination of electric and acoustic stimulation are present (e.g. so-called bimodal fittings), feedback may occur.

The hearing device may be configured to provide each of said respective electric input signals in a time-frequency representation (k,m) as frequency sub-band signals $X_i(k,m)$, i=1, . . . , M, where M is the number of input transducers, where k and m are frequency and time indices, respectively, and where k=1, . . . , K. The hearing device may comprise an analysis filter bank to provide a given electric input signal in a time-frequency representation. In an embodiment, each of the input paths from the M input transducers comprises an analysis filter bank. The analysis filter bank may comprise a Fourier transform algorithm, e.g. a Short Term Fourier Transform (STFT) algorithm, providing the frequency sub-band signals in a time-frequency representation (m,k), where each time frame (m) comprises K time-frequency units (e.g. STFT-bins), each comprising a complex value of a sub-band signal corresponding to a specific frequency index k at the time m in question. The hearing device may comprise a synthesis filter bank for converting an electric signal in a frequency sub-band (or time-frequency) representation to a signal in the time domain. The hearing device may comprise at least one synthesis filter bank (other synthesis filter banks may be necessary for hands-free telephony or binaural communication).

The adaptive beamformer filtering unit may comprise a first set of two (e.g. mutually orthogonal) beamformers:

a) a (first) beamformer $C_1$ which is configured leave a signal from a target direction (substantially) un-altered, and b) a (second) (e.g. orthogonal) beamformer $C_2$ which is configured to (substantially) cancel the signal from the target direction, and wherein the adaptive beamformer filtering unit is configured to provide a resulting directional signal $Y(k)=C_1(k)-\beta(k)C_2(k)$, where $\beta(k)$ is an adaptively updated adaptation factor defining said adaptively updated beamformer weights, where $\beta(k)$ is determined based on said feedback estimates. The adaptation factor $\beta(k)$ may be determined from the following expression $$\beta(k) = \frac{\langle C_{F2}^{*} C_{F1} \rangle}{\langle |C_{F2}|^2 \rangle + c}$$

where k is the frequency index, * denotes the complex conjugation and $\langle \bullet \rangle$ denotes the statistical expectation operator, and c is a constant, and where $(C_{F1}, C_{F2})$ constitute a second set of beamformers applied to said feedback path estimates in the frequency domain.

The term 'substantially' in connection with the first and second beamformers ('substantially unaltered' and 'substantially cancel', respectively) is intended to indicate a possible minor deviation from ideal properties of the beamformers in question. A complete cancellation of the a signal from a particular direction is typically not possible (at all frequencies) alone due to physical imperfections of the practical implantation of the particular hearing device the beamformers in question.

It should be noted that the 'target direction' may be seen as a specific direction such as the front direction (e.g. of a hearing aid user) or (for headset applications), the direction of own voice. Alternatively, the 'target direction' may be interpreted as a set of beamformer weights, which attenuate a range of directions, such as diffuse noise. This is especially relevant, if the two microphones are configured as in shown in FIG. 1A, where the 'target direction' may be considered as all external sounds. Thereby noise is minimized under the constraint that the signal from the target direction is unaltered. $\langle \bullet \rangle$ denotes an averaging of the signals, e.g. achieved by a $1^{st}$ order IIR lowpass filter (denoted LP in FIG. 2 and FIG. 4). Contrary to an adaptive beamformer that cancels the external noise, we expect that the 'noise' (i.e. feedback) will be more stable in the present setup (cf. FIG. 4). We thus have an advantage of a slower adaptation (longer time constants). If we detect a change in the feedback path, it would be an advantage, if the time constant is decreased (faster reaction) whenever a change in the feedback path has been detected.

The present beamformer structure ($Y=C_1-\beta C_2$) has the advantage that the factor $\beta$ responsible for noise reduction is only multiplied on the second (target-cancelling) beam pattern $C_2$ (so that the signal received from the target direction is not affected by any value of $\beta$). This constraint of a Minimum Variance Distortionless Response (MVDR) beamformer is a built in feature of the generalized sidelobe canceller (GSC) structure.

As discussed in EP3253075A1, $\beta(k)$ may be determined directly from the noise covariance matrix derived from the input signals (e.g. via feedback path estimates) and the beamformer weights without the intermediate step of calculating the fixed beamformers. This may be an advantage in situations where the fixed beamformer weights can change. In other words, we may determine β either directly from the signals (here for a two input situation)

$$C_1=w_{C1}^H x \text{ and } C_2=w_{C2}^H x$$

where x represents the electric input signals, e.g. the microphone signals ($(X_1, X_2)$ in FIG. 1) or the feedback estimates ($\hat{F}_1(k)$, $\hat{F}_2(k)$ in FIG. 4). Alternatively, we may determine β from the noise covariance matrix $C_v$, i.e.

$$\beta = \frac{w_{C1}^H C_v w_{C2}}{w_{C2}^H C_v w_{C2}}$$

where $w_{C1}=(w_{11}(k), w_{12}(k))^T$ is a vector comprising a first set of complex frequency dependent weighting parameters representing said first beam former ($C_1$), and $w_{C2}=(w_{21}(k), w_{22}(k))^T$ is a vector comprising a second set of complex frequency dependent weighting parameters representing said second beam former ($C_2$). This may be a choice of implementation. It should be emphasized that the noise covariance matrices C may be derived from the feedback estimates:

$$C_v=\langle FF^H \rangle$$

where $$F=[\hat{F}_1(k),\hat{F}_2(k)]^T$$

or alternatively expressed $$C_v=\langle [\hat{F}_1(k),\hat{F}_2(k)]^T[\hat{F}_1^*(k),\hat{F}_2^*(k)] \rangle$$

where $^T$ denotes transposition, $^H$ denotes transposition and complex conjugation (and * denotes complex conjugation), and ⟨•⟩ denotes time average (e.g. equivalent to a low-pass filtering, e.g. implemented by an IIR-filter).

Instead of absolute feedback path estimates from an output transducer to each of the input transducers, a reference input transducer may be selected and absolute feedback path determined to the reference input transducer and the relative feedback paths from this input transducer to the rest of the input transducers. Thereby update of feedback path estimates can be simplified.

The advantage of using the feedback path estimates contrary to the microphone signals is that the update of the adaptive beam pattern will be less affected by external sounds (cf. FIG. 1A).

The first set of (e.g. two mutually orthogonal) beamformers ($C_1$, $C_2$) may be fixed. The first set of two (e.g. mutually orthogonal) beamformers ($C_1$, $C_2$) may be adaptively determined.

The second set of beamformers ($C_{F1}$, $C_{F2}$) may be fixed. In an embodiment, the second set of beamformers ($C_{F1}$, $C_{F2}$) are adaptively determined.

The second set of beamformers ($C_{F1}$, $C_{F2}$) may have the same weights ($w_{11}$, $w_{12}$), ($w_{21}$, $w_{22}$) as the first set of beamformers ($C_1$, $C_2$), but may be derived from the feedback path estimates ($\widehat{F_1}$, $\widehat{F_2}$). In other words, $$C_{F1}=w_{C1}^H\hat{F} \text{ and } C_{F2}=w_{C2}^H\hat{F}$$

where $\hat{F}$ represents the feedback estimates (cf. ($\hat{F}_1(k)$, $\hat{F}_2(k)$) of the exemplary two-microphone embodiment of FIG. 4).

The hearing device may comprise a memory comprising a first set of complex frequency dependent weighting parameters $w_{11}(k)$, $w_{12}(k)$ representing said first beam former ($C_1$), a memory comprising a second set of complex frequency dependent weighting parameters $w_{21}(k)$, $w_{22}(k)$ representing a second beam former ($C_2$), where said first and second sets of weighting parameters $w_{11}(k)$, $w_{12}(k)$ and $w_{21}(k)$, $w_{22}(k)$, respectively, are predetermined, e.g. as initial values, which are possibly updated during operation of the hearing device.

The memory may be implemented as one memory or as separate memories. The memory may e.g. form part of a processor or any other functional unit.

The number of sets of predefined feedback path estimates may corresponding to specific acoustic situations for each of said multitude of input transducers may be stored in a memory of the hearing device. In an embodiment, a number of different predetermined feedback paths, e.g. with and without hand at ear, are stored in a memory of the hearing device. An appropriate feedback path may be chosen, and used for determining the adaptive beamformer weights β(k) in dependence on the specific feedback situation.

The adaptive beamformer filtering unit may comprise a number of different fixed beamformers that can be switched in in dependence of the acoustic situation.

Alternatively or additionally, the hearing device may be configured to control an adaptation rate of the feedback estimation unit (algorithm) in dependence of the "distance" (e.g. an Euclidean distance, e.g. of the magnitude and/or phase, or the logarithm of these, e.g. at different frequencies) between respective reference feedback paths and current feedback path estimates. Thereby a relatively slow adaptation may be applied, whenever the current feedback path estimate is close to one of the reference feedback estimates. The 'adaptivity' of the beamformer primarily was related to β via the updates of the feedback estimates (cf. FIG. 4). The fixed beamformers may, however, be updated every now and then (=>adaptive). In an embodiment, an own voice beamformer focused on the user's mouth and an environment sound beamformer focused on a sound source of interest in the environment of the user are simultaneously created using the electric input signals.

The adaptively updated beamformer weights, e.g. the frequency dependent adaptation factor β(k) may be a combination or an optimal adaptation factor $\beta_{mic}(k)$ derived from the electric input signals (cf. e.g. lower part of FIG. 2) and an adaptation factor $\beta_{FBE}(k)$ derived from the feedback estimates (cf. e.g. lower part of FIG. 4). A resulting adaptation factor $\beta_{mix}(k)$ may be a linear combination of the optimal adaptation factor $\beta_{mic}(k)$ and the feedback-estimate based adaptation factor $\beta_{FBE}(k)$:

$$\beta(k)=\alpha\cdot\beta_{mic}(k)+(1-\alpha)\cdot\beta_{FBE}(k)$$

where α is a (e.g. real) weighting factor having values between 0 and 1. The weighting factor α may be fixed or adaptively determined. The weighting factor α may e.g. be determined in dependence of an input level (e.g. a level L of the electric input signal(s)). The weighting factor α may e.g. increase from 0 to 1 with increasing level (L), e.g. in a step like or piecewise linear or monotonous (e.g. sigmoid, or sigmoid-like) manner A value of the weighting factor α close to 0 represents a configuration or acoustic situation focused on reducing external noise in a (far-field) acoustic input signal. A value of the weighting factor α close to 1 represents a configuration or acoustic situation focused on reducing feedback from a (near-field) acoustic input signal (the loudspeaker of the hearing device).

The hearing device may comprise a detector of a current acoustic environment, the detector providing an environment detection signal indicative of a current feedback situation.

The hearing device may be configured to apply a relevant set of predefined feedback estimates to provide the second set of beamformers $C_{F1}$, $C_{F2}$.

The hearing device may comprise a feedback suppression system for suppressing feedback from said output transducer to at least one of said input transducers. The hearing device may comprise a feedback suppression system for suppressing feedback from said output transducer to each of said multitude of input transducers. The feedback suppression system may e.g. be configured to subtract the current estimate of the current feedback paths from said output transducer to each of said input transducers from the respective electric input signals (or signals derived therefrom). The feedback system may comprise respective subtraction units for subtracting the estimate of the current feedback path of a given input transducer from the electric input signal provided by that input transducer. In an embodiment, the estimate of the current feedback path is provided in the time domain. In an embodiment, the estimate of the current feedback path is provided in the (time-)frequency domain. The feedback suppression system may e.g. be configured to estimate the feedback paths of all M input transducers and to subtract a current estimate of the feedback path from the respective (current) electric input signal (or a processed version thereof), cf. e.g. FIG. 4. An extra set of analysis filter banks may be used to convert the estimated time domain feedback path estimates into time-frequency domain feedback estimates.

The hearing device may consist of or comprise a hearing aid, a headset, an ear protection device or a combination thereof. It should be noted, that in a headset, the target sound would generally be own voice of the wearer of the headset.

The hearing device may comprise an ITE-part adapted for being located at or in an ear canal of the user, the ITE-part comprising a housing comprising a seal towards walls or the ear canal so that the ITE part fits tightly to the walls of the ear canal or at least provides a controlled or minimal leakage channel for sound, the ITE part comprising at least two microphones located outside the sealing facing the environment, and at least one microphone located inside the seal and facing the ear drum. A microphone inside the sealing mainly record the feedback signal, and for that reason it does not re-introduce noise, which has already been removed by the beamforming signal obtained from the two microphones outside the sealing.

A First Further Hearing Device:

In an aspect, a first further hearing device is provided by the present disclosure. The hearing device, e.g. a hearing aid, is configured to be located at or in an ear of a user. The hearing device comprises an ITE-part adapted for being located at or in an ear canal of the user. The ITE-part comprises

- a housing configured to be located at least partially in the ear canal of the user, the housing possibly comprising a seal towards walls or the ear canal so that the ITE part fits tightly to the walls of the ear canal or at least provides a controlled or minimal leakage channel for sound,
- at least three input transducers for providing respective electric input signals, wherein at least two input transducers facing the environment and providing respective electric input signals representing sound in an environment of the user, and at least one input transducer facing an ear drum and providing at least one electric input signal representing sound reflected from the ear drum, when the ITE-part is operationally mounted at or in the ear canal;
- an output transducer for providing stimuli perceivable to the user as sound based on said electric input signals or a processed version thereof;
- a beamformer filtering unit connected to said at least three input transducers and to said output transducer, and configured to provide a spatially filtered signal based on said at least three electric input signals and appropriate beamformer weights;
- wherein said beamformer filtering unit comprises
  - a first beamformer for spatial filtering said sound in the environment based on said electric input signals from said at least two input transducers facing the environment, and
  - a second beamformer for spatial filtering sound reflected from the ear drum based on said at least one electric input signal from said at least one input transducer facing the ear drum and at least one of said electric input signals from said at least two input transducers facing the environment.

It is the intention that the hearing device features outlined for the hearing device above and the hearing device features outlined below under the heading 'further hearing aid features' (and in the detailed description of embodiments, and in the claims) are combinable with the first further hearing device, where appropriate.

A microphone inside the sealing mainly record the feedback signal, and for that reason it does not re-introduce noise, which has already been removed by the beamforming signal obtained from the two microphones outside the sealing.

The first and second beamformers are preferably simultaneously available.

The stimuli may be directed towards the ear drum when the ITE part is operationally mounted in the ear canal. The output transducer may be a loudspeaker.

The at least two microphones facing the environment and the at least one input transducer facing the ear drum are located on each side of the seal.

Directional weights for different frequency channels may be used for different purposes. In frequency channels, where feedback is dominant, the directional system may be used for feedback cancellation, while the directional system may be used for noise reduction (of external noise sources or microphone noise) in frequency channels, where feedback is not significant.

A Second Further Hearing Device:

In an aspect, a second further hearing device is provided by the present disclosure. The hearing device, e.g. a hearing aid, is configured to be located at or in an ear of a user. The hearing device comprises

- at least two input transducers for providing respective electric input signals;
- an output transducer for providing stimuli perceivable to the user as sound based on said electric input signals or a processed version thereof;
- a feedback estimation unit providing feedback estimate(s) of current feedback path(s) from said output transducer to at least one of said at least two input transducers;
- a beamformer filtering unit connected to said at least two input transducers and to said output transducer, and configured to provide a spatially filtered signal based on said at least two electric input signals and appropriate beamformer weights;

a post filter connected to said beamformer filtering unit and configured to provide frequency and time dependent gains to be applied to said spatially filtered signal to thereby further reduce noise therein;

wherein said beamformer filtering unit and/or said post filter is/are updated using said feedback estimate(s).

It is the intention that the hearing device features outlined for the hearing device and the first further hearing device above and the hearing device features outlined below under the heading 'further hearing aid features' (and in the detailed description of embodiments, and in the claims) are combinable with the second further hearing device, where appropriate.

The part of the beamformer filtering unit providing the spatially filtered signal may be updated using feedback estimate(s).

The post filter may determine gains based on a noise estimate provided by the feedback estimates.

The beamformer filtering unit providing the spatially filtered signal and the post filter providing the frequency and time dependent gains to be applied to said spatially filtered signal may be updated based on the feedback estimate(s).

The hearing device may be configured to provide a feedback estimate for each of the at least two input transducers. The beamformer filtering unit and/or the post filter may be updated using each of the individual feedback estimates or a combination of the feedback estimates, e.g. an average or a maximum value.

Hearing Device Features:

It is the intention that the following features are combinable with the hearing device and the first and second further hearing devices described above (and in the detailed description of embodiments, and in the claims), where appropriate.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

The hearing device comprises an output unit for providing a stimulus perceived by the user as an acoustic signal based on a processed electric signal. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored or bone-conducting hearing device).

In an embodiment the hearing device comprises another output unit for providing stimulus for another user, e.g. as far-end input for a phone conversation. The output units may be connected to a signal processor allowing a control of the output signal presented via the respective output units (e.g. a transmitter, or a further output transducer), different signals presented via the different output units, e.g. one signal intended for being presented to the user, another signal intended for being presented to an external device (e.g. another person). The hearing device may be configured to pick up the user's own voice (e.g. via a predefined (or adaptive) beamformer focusing on the mouth of the user), e.g. in a specific mode of operation (e.g. a communication or telephone mode).

The hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. The number of input transducers, e.g. microphones, may be larger than or equal to two, such as larger than or equal to three, such as larger than or equal to four.

The hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates (e.g. a target signal and/or a noise signal). This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal.

Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain) In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In connection to removing feedback, own voice or jaw movements could change the feedback path. Hence, it may be advantageous to increase the adaptation rate when own voice or jaw movements has been detected.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system.

The hearing device comprises a feedback estimation unit for providing a feedback signal representative of an estimate of the acoustic feedback path, and a combination unit, e.g. a subtraction unit, for subtracting the feedback signal from a signal of the forward path (e.g. as picked up by an input transducer of the hearing device). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$. In an embodiment, the hearing device is configured to provide that the configurable update frequency $f_{upd}$ has a maximum value $f_{upd,max}$. In an embodiment, the maximum value $f_{upd,max}$ is a fraction of a sampling frequency $f_s$ of an AD converter of the hearing device ($f_{upd,max}=f_s/D$).

The update part of the adaptive filter comprises an adaptive algorithm for calculating updated filter coefficients for being transferred to the variable filter part of the adaptive filter. The timing of calculation and/or transfer of updated filter coefficients from the update part to the variable filter part may be controlled by the activation control unit. The timing of the update (e.g. its specific point in time, and/or its update frequency) may preferably be influenced by various properties of the signal of the forward path. The update control scheme is preferably supported by one or more detectors of the hearing device, preferably included in a predefined criterion comprising the detector signals.

In an embodiment, the hearing device further comprises other relevant functionality for the application in question, e.g. compression, noise reduction, active noise cancellation, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing aids (e.g. hearing instruments), headsets, ear phones, active ear protection systems, etc., e.g. in handsfree telephone systems, teleconferencing systems, public address systems, karaoke systems, classroom amplification systems, etc.

A Method:

In an aspect, a method of suppressing feedback in a hearing device adapted for being located at or in an ear, or to be fully or partially implanted in the head at an ear, of a user, the hearing device comprising a multitude of input transducers and an output transducer connected to each other is provided by the present disclosure. The method comprises

- providing a multitude of electric input signals representing sound in an environment of the user;
- providing stimuli perceivable to the user as sound based on said electric input signals or a processed version thereof;
- providing a spatially filtered signal based on said multitude of electric input signals and adaptively updated beamformer weights;
- providing feedback estimates of current feedback paths from said output transducer to each of said input transducers; and
- providing that at least one of said adaptively updated beamformer weights is/are updated in dependence of said feedback path estimates.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The method may comprise providing three or more electric input signals, wherein at least some of them are used for spatial filtering and reduction of noise in said sound in the environment, and wherein at least some of them are used for feedback cancellation, and where at least one of the electric input signals is used for both.

The directional weights for different frequency channels may be used for different purposes. In frequency channels, where feedback is dominant, the directional system may be used for feedback cancellation, while the directional system may be used for noise reduction (of external noise sources or microphone noise) in frequency channels, where feedback is not significant.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like. The hearing system may further comprise a device (e.g. a microphone or other sensor or processing device) located elsewhere on the body of (e.g. at another ear of) the user, or a device worn by or located at another person.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s).

Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as applications.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1B:
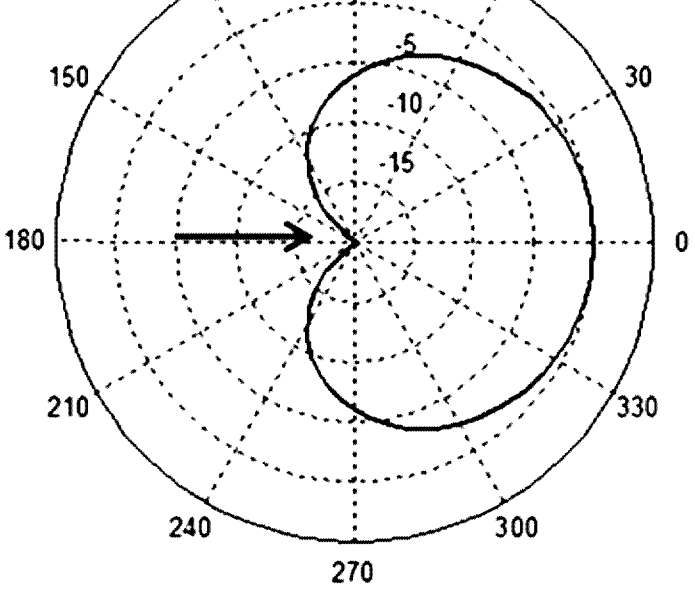
FIGS. 1A and 1B show a hearing device containing two microphones located in the ear canal adapted for cancelling sound propagated by the feedback path by applying a fixed or an adaptive directional gain.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular to feedback from an output transducer to an input transducer of the hearing device.

EP2843971A1 deals with a hearing aid device comprising an "open fitting" providing ventilation, a receiver arranged in the ear canal, a directional microphone system comprising two microphones arranged in the ear canal at the same side of the receiver and means for counteracting acoustic feedback on the basis of sound signals detected by the two microphones. An improved feedback reduction can thereby be achieved, while allowing a relatively large gain to be applied to the incoming signal.

In state of the art hearing aids omnidirectional microphones are known to provide satisfactory audiological performance for very small hearing instruments located almost invisibly in the ear canal entrance. It is also known that for slightly bigger hearing aids with microphones placed further out in the ear or behind the pinna, increased audiological performance can be obtained from the use of a directional microphone system. Such a directional system is able to distinguish between sounds coming from the frontal area seen from the hearing aid users' perspective and sounds from other directions in the horizontal plane. Hence from a conventional point of view, CIC hearing instruments only have one microphone and larger ITE instruments often have two microphones for directional performance.

Both the small CIC and the larger ITE hearing instruments have limited acoustic gain from incoming sound at the microphone to the acoustic receiver output. This gain is limited by feedback problems due to unwanted signal transmission from the receiver back into the microphone. This problem may be alleviated by anti-feedback systems based on feedback path estimation; this is well known.

An anti-feedback solution based on spatial resolution of the signal has is proposed in the present disclosure.

Feedback in hearing aids is typically reduced by subtracting the estimated feedback path from the microphone signal. Often hearing aids contain more than one microphone. Hereby, the spatial information of the microphones may be used to remove feedback. In an aspect, we consider a special microphone configuration (cf. FIG. 1), which is well suited for directional feedback cancellation without altering the target signal.

FIG. 1 shows a hearing device containing two microphones located in the ear canal adapted for cancelling sound propagated by the feedback path by applying a fixed or an adaptive directional gain.

Adaptive beamforming in hearing instruments aims at cancelling unwanted noise under the constraint that sounds from the target direction is unaltered. An example of such an adaptive system is illustrated in FIG. 2, where the output signal in the k'th frequency channel Y(k) is based on a linear combination of two fixed beamformers $C_1(k)$ and $C_2(k)$, i.e. $Y(k)=C_1(k)-\beta(k)\,C_2(k)$, where $C_1(k)$ and $C_2(k)$ preferably are orthogonal beamformers, and while $C_1(k)$ preserves the target direction, $C_2(k)$ is a beamformer, which cancel sound from the target direction.

Figure 2:
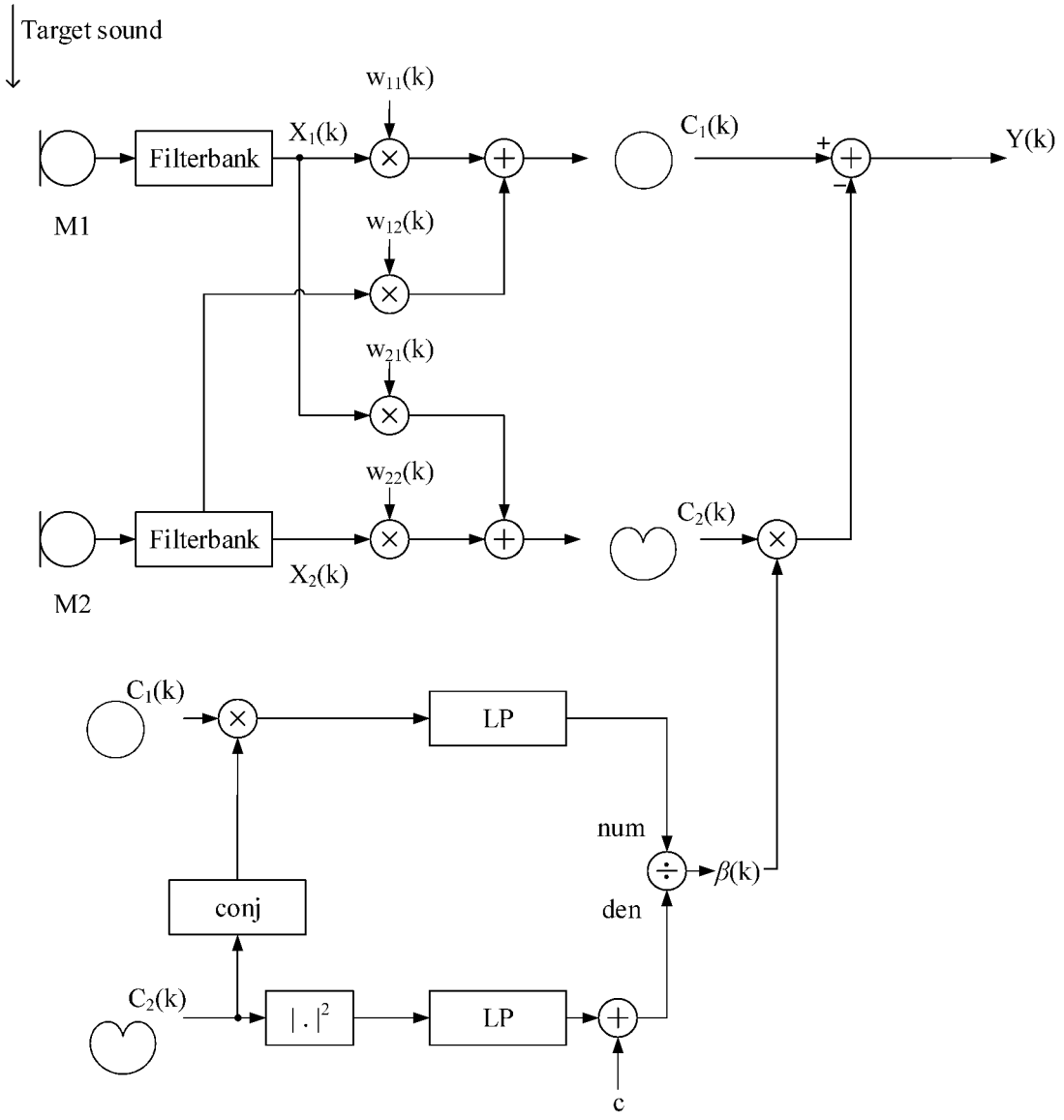
FIG. 2 shows an embodiment of a two-microphone MVDR beamformer according to the present disclosure.

FIG. 2 shows an embodiment of a two-microphone MVDR beamformer according to the present disclosure. Based on the two microphones, two fixed beamformers are created: a beamformer $C_1$ which do not alter the signal from the target direction, and an (orthogonal) beamformer $C_2$ which cancels the signal from the target direction. The resulting directional signal $Y(k)=C_1(k)-\beta(k)C_2(k)$, where $$\beta(k) = \frac{\langle C_2^* C_1 \rangle}{\langle |C_2|^2 \rangle + c}$$

minimizes the noise under the constraint that the signal from the target direction is unaltered. LP denotes an averaging of the signals, e.g. achieved by a 1st order IIR lowpass filter.

The adaptation factor β(k) is a weight applied to the target cancelling beamformer. Hereby, we can adapt β(k) knowing that the target direction is unaltered. In the case where we would like to cancel feedback, all external sounds are considered as sounds of interest. With the chosen microphone configuration, all external sounds will pass the first microphone before it reaches the second microphone, as illustrated in FIG. 3.

Figure 3:
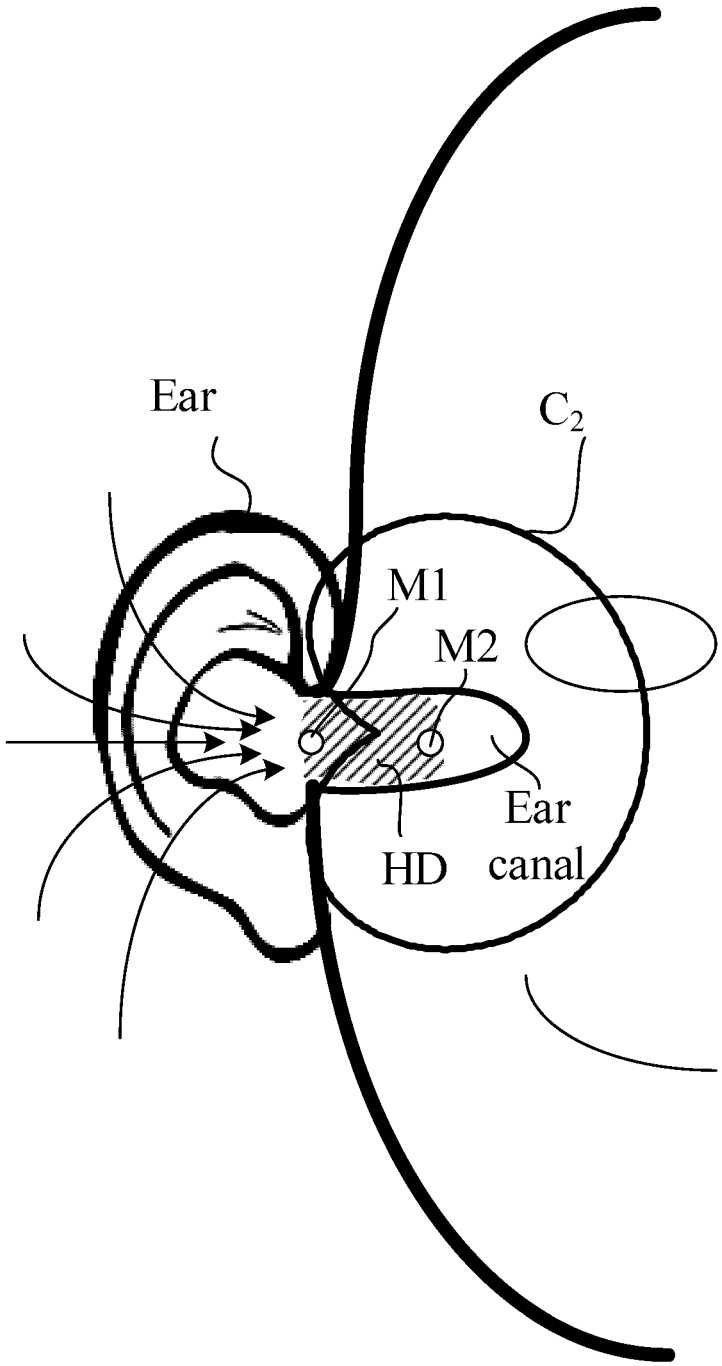
FIG. 3 illustrates a hearing device comprising a beamformer filtering unit according to the present disclosure, where the beamformer filtering unit provides a target cancelling beamformer for cancelling sound from a target signal in the acoustic far-field as illustrated by the cardioid.

FIG. 3 shows a hearing device comprising a beamformer filtering unit according to the present disclosure, where the beamformer filtering unit provides a target cancelling beamformer for cancelling sound from a target signal in the acoustic far-field as illustrated by the cardioid. The cardioid is here illustrated as a directional pattern, but in fact, the beam pattern not only depends on the source direction; it also changes as function of distance between the sound source and the microphones. The target cancelling beamformer is configured to cancel signals impinging the hearing aid. Due to the microphone configuration, external sounds first have to pass the first microphone and secondly have to pass the second microphone. Seen from the hearing aid, most external sounds will thus have approximately the same delay. Hereby the target cancelling beamformer will work efficiently for most target directions.

Another difference between the external sound and the feedback sound is that the feedback sound most likely has the highest sound pressure level at the inner microphone while the external sounds most likely have the highest sound pressure level at the outer microphone. In an embodiment, the hearing device is configured to compare the levels of the inner and outer microphones at a given point in time (e.g. when feedback is detected).

In other words, all external sounds may (seen from the hearing instrument microphones) be considered as a sound from one distinct direction. We thus propose to estimate the target cancelling beamformer such that it minimizes sounds imping from all external directions. This may e.g. be achieved based on impulse response recordings of external sounds from various external directions (e.g. to determine predefined weights based on measurements). Alternatively, the target cancelling beamformer may be estimated based on a response from the preferred direction (i.e. choose one direction and determine a fixed beamformer (e.g. beamformer weights) for this direction, preferably the front direction, or the own voice direction). A third option is to adapt the target cancelling beamformer to the current listening direction, i.e. at any time cancel the external sound. Such an adaptive target cancelling beamformer could be updated whenever the external sound is much louder than the feedback signal. The task of the target cancelling BF is to estimate the 'noise', which is the feedback 'from the ear drum'. Due to compression, we have relatively less feedback at high external input levels compared to low input levels, as we typically need less amplification at high input levels.

Contrary to the typical update of the adaptive coefficient β(k), which is based directly on the microphone signals, we propose to update the coefficient based on the feedback path estimates.

The advantage is that the adaptive beamformer hereby will depend less on external sounds. A disadvantage may be that the beamformer relies on the feedback path estimates, and for that reason cannot react faster than the feedback path estimates. Still, it is likely that the adaptive beamformer will be able to attenuate the feedback path estimate even though the beampattern is not perfectly adapted.

Some feedback path estimates are more reliable than others. Hereby not all values of $\beta(k)$ will represent a likely feedback. Considering the adaptation value $\beta(k)$ may thus provide an estimate on how reliably the current (single microphone) feedback path estimates are.

Figure 4:
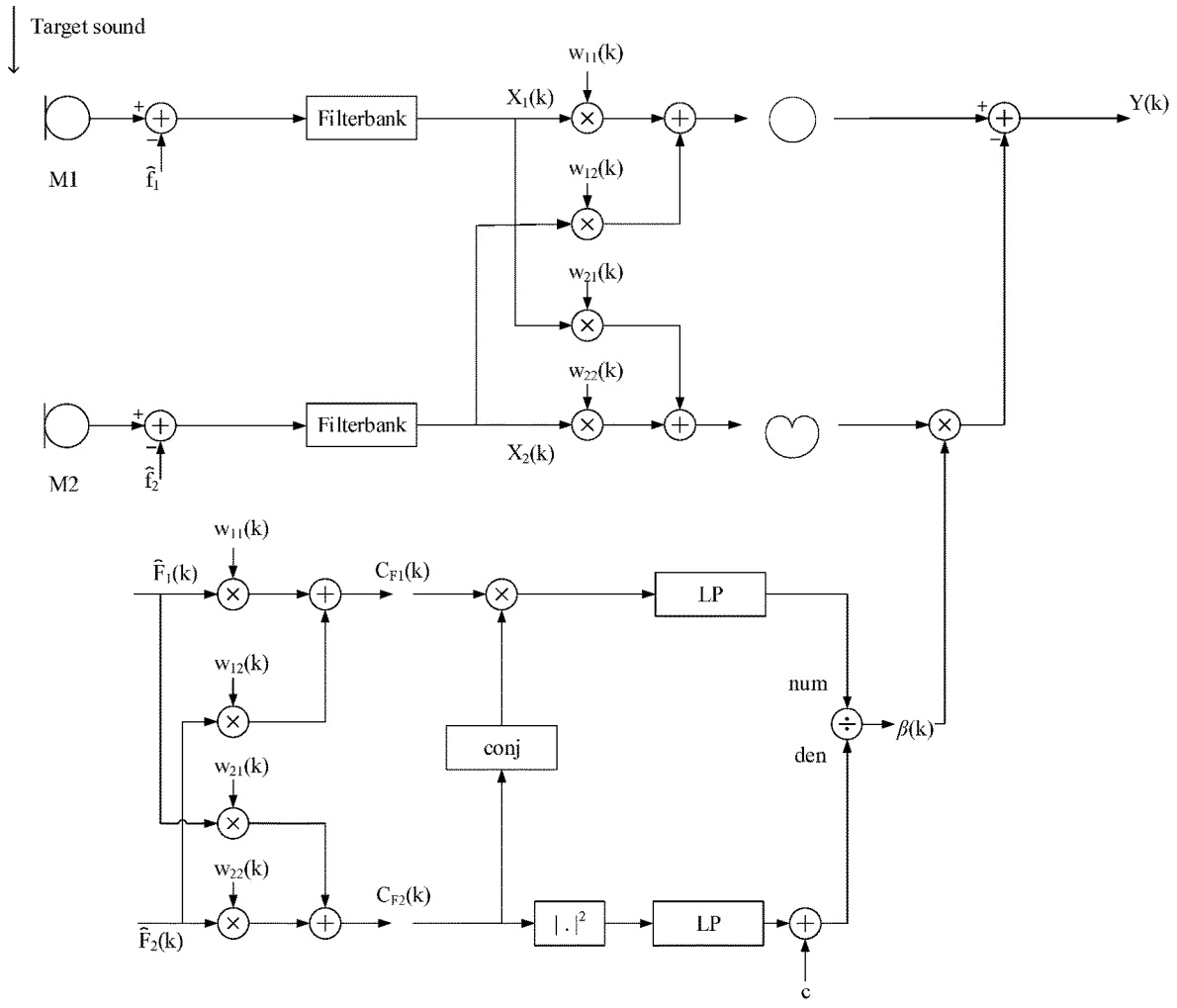
FIG. 4 shows a further embodiment of a two-microphone MVDR beamformer as illustrated in FIG. 2, FIG. 5 schematically shows an embodiment of a RITE-type hearing device according to the present disclosure comprising a BTE-part, an ITE-part and a connecting element.

FIG. 4 shows a further embodiment of a two-microphone MVDR beamformer as illustrated in FIG. 2. The beamformer filtering unit is based on two fixed beamformers: a beamformer $C_1$ which does not alter the signal from the target direction, and an (orthogonal) beamformer $C_2$ which cancels the signal from the target direction. The target direction is the direction of all external sounds, which, due to the microphone configuration, may be seen as a single direction. The resulting directional signal is still given by $Y(k)=C_1(k)-\beta(k)C_2(k)$, but contrary to FIG. 2, the adaptation factor $\beta(k)$ is estimated based on another set of fixed beamformers having the same weights ($w_{11}$, $w_{21}$, $w_{12}$, $w_{22}$) but in this case applied to the (frequency domain) feedback path estimates ($\widehat{F_1}$, $\widehat{F_2}$) as input. The adaptation factor is thus given by $$\beta(k) = \frac{\langle C_{F2}^{*} C_{F1} \rangle}{\langle |C_{F2}|^2 \rangle + c}$$

The advantage of using the feedback path estimates contrary to the microphone signals is that the update of the adaptive beam pattern will be less affected by external sounds.

Figure 5:
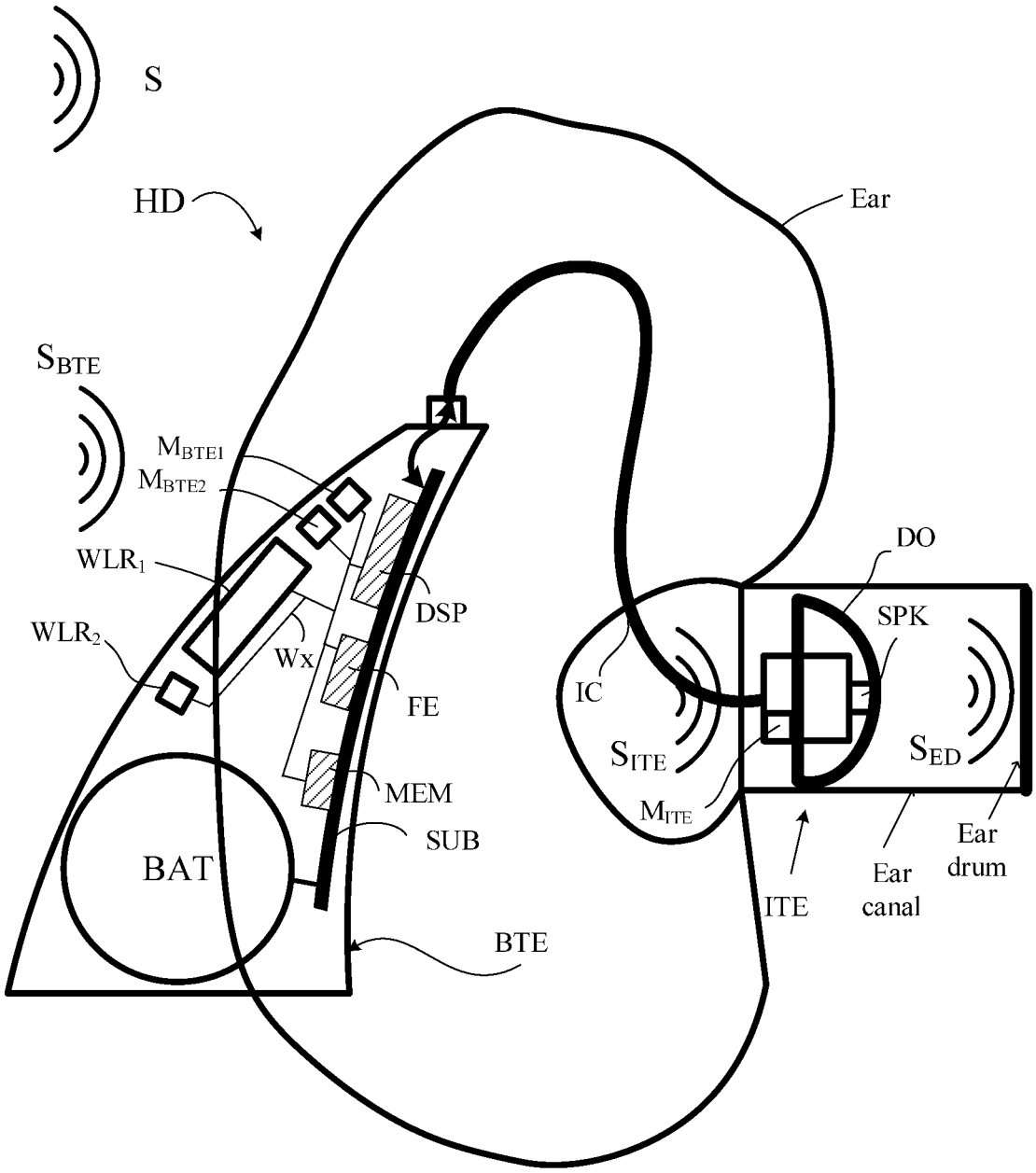

FIG. 5 schematically shows an embodiment of a hearing device according to the present disclosure. The hearing device (HD), e.g. a hearing aid, is of a particular style (sometimes termed receiver-in-the ear, or RITE, style) comprising a BTE-part (BTE) adapted for being located at or behind an ear of a user, and an ITE-part (ITE) adapted for being located in or at an ear canal of the user's ear and comprising a receiver (loudspeaker). The BTE-part and the ITE-part are connected (e.g. electrically connected) by a connecting element (IC) and internal wiring in the ITE- and BTE-parts (cf. e.g. wiring Wx in the BTE-part).

In the embodiment of a hearing device in FIG. 5, the BTE part comprises two input units ($M_{BTE1}$, $M_{BTE2}$, cf. also e.g. M2, M2 in FIGS. 2, 3, 4) comprising respective input transducers (e.g. microphones), each for providing an electric input audio signal representative of an input sound signal ($S_{BTE}$) (originating from a sound field S around the hearing device). The input unit further comprises two wireless receivers ($WLR_1$, $WLR_2$) (or transceivers) for providing respective directly received auxiliary audio and/or control input signals (and/or allowing transmission of audio and/or control signals to other devices). The hearing device (HD) comprises a substrate (SUB) whereon a number of electronic components are mounted, including a memory (MEM) e.g. storing different hearing aid programs (e.g. parameter settings defining such programs, or parameters of algorithms, e.g. optimized parameters of a neural network) and/or hearing aid configurations, e.g. input source combinations ($M_{BTE1}$, $M_{BTE2}$, $WLR_1$, $WLR_2$), e.g. optimized for a number of different listening situations. The substrate further comprises a configurable signal processor (DSP, e.g. a digital signal processor, including a processor (e.g. for hearing loss compensation (HLC)), feedback suppression (FBC) and beamformers (BFU) and other digital functionality of a hearing device according to the present disclosure). The configurable signal processing unit (DSP) is adapted to access the memory (MEM) and for selecting and processing one or more of the electric input audio signals and/or one or more of the directly received auxiliary audio input signals, based on a currently selected (activated) hearing aid program/parameter setting (e.g. either automatically selected, e.g. based on one or more sensors and/or on inputs from a user interface). The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front-end IC (FE) for interfacing the configurable signal processor (DSP) to the input and output transducers, etc., and typically comprising interfaces between analogue and digital signals. The input and output transducers may be individual separate components, or integrated (e.g. MEMS-based) with other electronic circuitry.

The hearing device (HD) further comprises an output unit (e.g. an output transducer) providing stimuli perceivable by the user as sound based on a processed audio signal from the processor (HLC) or a signal derived therefrom. In the embodiment of a hearing device in FIG. 5, the ITE part comprises the output unit in the form of a loudspeaker (receiver) for converting an electric signal to an acoustic (air borne) signal, which (when the hearing device is mounted at an ear of the user) is directed towards the ear drum (Ear drum), where sound signal ($S_{ED}$) is provided. The ITE-part further comprises a guiding element, e.g. a dome, (DO) for guiding and positioning the ITE-part in the ear canal (Ear canal) of the user. The ITE-part further comprises a further input transducer, e.g. a microphone ($M_{ITE}$), for providing an electric input audio signal representative of an input sound signal ($S_{ITE}$). In an embodiment, the ITE-part comprises two or more input transducers configured as discussed in the present disclosure (cf. FIGS. 1-4, 6-8).

The electric input signals (from input transducers $M_{BTE1}$, $M_{BTE2}$, $M_{ITE}$) may be processed according to the present disclosure in the time domain or in the (time-) frequency domain (or partly in the time domain and partly in the frequency domain as considered advantageous for the application in question). In an embodiment, one degree of freedom is used to suppress the external noise, and the other degree of freedom is used to suppress the feedback, see e.g. FIGS. 7C, 7D.

The hearing device (HD) exemplified in FIG. 5 is a portable device and further comprises a battery (BAT), e.g. a rechargeable battery, e.g. based on Li-Ion battery technology, e.g. for energizing electronic components of the BTE- and possibly ITE-parts. In an embodiment, the hearing device, e.g. a hearing aid (e.g. the processor (HLC)), is adapted to provide a frequency dependent gain and/or a level dependent compression and/or a transposition (with or without frequency compression) of one or more frequency ranges to one or more other frequency ranges, e.g. to compensate for a hearing impairment of a user.

Figure 1A:
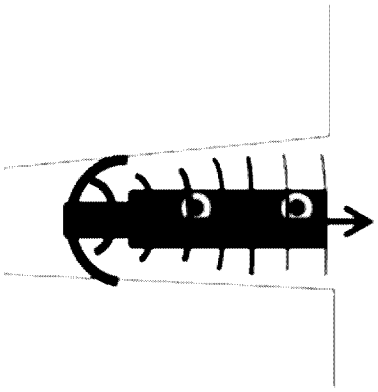
Figure 6:
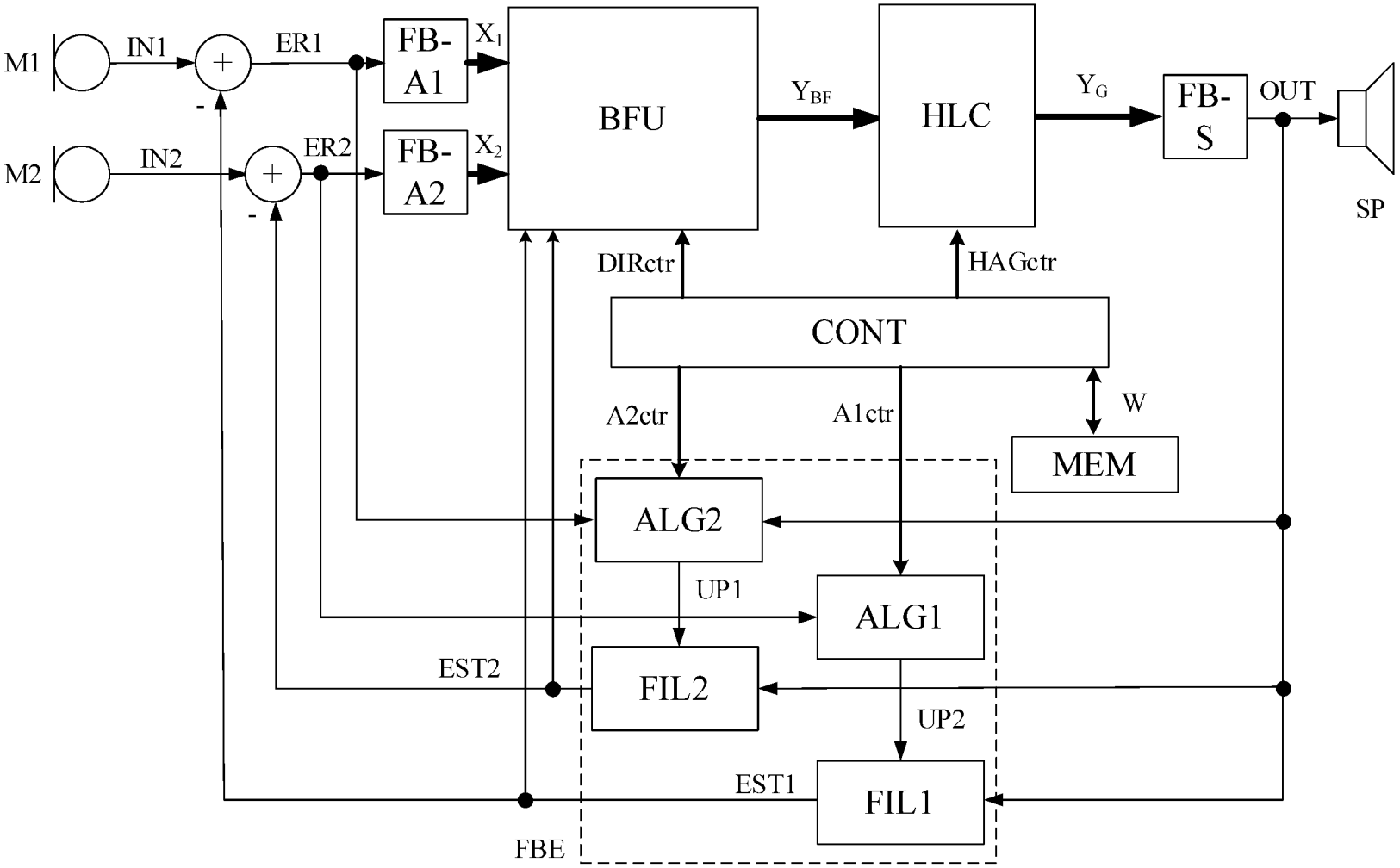
FIG. 6 shows a schematic block diagram of an embodiment of a hearing device comprising two microphones according to the present disclosure.

FIG. 6 shows a schematic block diagram of an embodiment of a hearing device comprising two microphones according to the present disclosure. The hearing device, e.g. a hearing aid, comprises first and second input transducers (e.g. located in an ear canal as shown in FIG. 1A or FIG. 3), here microphones (M1, M2), providing respective (e.g. digitized) electric input signals, IN1, IN2, representing sound in an environment of the user. The input units are via an electric forward path connected to an output transducer, here loudspeaker ('receiver') (SP) for converting a processed electric signal, OUT, to stimuli perceivable to the user as sound based on the electric input signals or a processed version thereof. The forward path comprises respective analysis filter banks (FB-A1, FB-A2) for converting respective (time domain) electric input signals ER1, ER2 (being feedback corrected versions of respective electric input signals IN1, IN2) (as explained below) to frequency sub-band signals X1, X2. The forward path of the hearing device (HD) further comprises an adaptive beamformer filtering unit (BFU) receiving the frequency sub-band signals X1, X2 and estimates of the feedback paths EST1, EST2 from the output transducer to respective first and second input transducers (as described below). The adaptive beamformer filtering unit (BFU) is configured to provide spatially filtered signal $Y_{BF}$ based on the electric input signals, the feedback estimates, and adaptively updated beamformer weights (e.g. based on the feedback estimates according to the present disclosure).

The hearing device further comprises a feedback estimation unit (FBE) providing feedback estimates (EST1, EST2) of current feedback paths from the output transducer (SP) to each of the input transducers (M1, M2). The hearing device is configured to provide that at least one of the adaptively updated beamformer weights of the adaptive beamformer filtering unit (BFU) is/are updated in dependence of the feedback path estimates (EST1, EST2) as proposed by the present disclosure. The feedback estimation unit (FBE) comprises respective first and second adaptive filters, each comprising a variable filter part (FIL1, FIL2) and a prediction error or update or algorithm part (ALG1, ALG2) aimed at providing a good estimate of the 'external' feedback path from the (input to the) output transducer (SP) to the (output from the) respective input transducers (M1, M2). The respective prediction error algorithms (ALG1, ALG2) uses a reference signal (here the output signal OUT) together with a signal originating from the respective microphone signal to find the setting (reflected by filter update signals UP1, UP2 in FIG. 6) of the adaptive filter (FIL1, FIL2) that minimizes the prediction error, when the reference signal (OUT) is applied to the respective adaptive filter. The estimate of the feedback paths (EST1, EST2) provided by the respective adaptive filter are subtracted from the respective electric input signals IN1, IN2 from the microphones (M1, M2) in respective sum units '+', providing so-called 'error signals' (or feedback-corrected signals ERR1, ERR2), which are fed to the beamformer filtering unit (BFU) (via respective analysis filter banks FB-A1, FB-A2) and to the respective algorithm parts (ALG1, ALG2) of the adaptive filters.

The hearing device (HD) further comprises control unit (CONT) for controlling the feedback estimation unit (FBE), cf. control signals A1ctr, A2ctr, and the beamformer filtering unit (BFU). The control unit (CONT) is e.g. configured to control the adaptation rate of the adaptive algorithm (e.g. defined by the points in time where the feedback estimate is determined (and updated), cf. signals UP1, UP2). In the embodiment of FIG. 6, the control unit (CONT) may further comprise detectors for classifying a current acoustic environment of the user, e.g. a current feedback situation, e.g. indicating the degree of correlation between the electric input signal (or a signal derived therefrom) and the electric output signal. The control unit (CONT) may e.g. comprise a correlation detection unit for determining the auto-correlation of a signal of the forward path or the cross-correlation between two different signals of the forward path. The control unit (CONT) may further comprise other detectors, e.g. a speech detector, a feedback detector, a tone detector, an audibility detector, a feedback change detector, etc. Preferably, the hearing device (e.g. the control unit CONT or the algorithm part (ALG1, ALG2)) comprises a memory for storing a number of previous estimates of the feedback path, in order to be able to rely on a previous estimate, if a current estimate is judged (e.g. by the control unit CONT) to be less optimal. The control unit may store or have access to via a memory (MEM) to a number of beamformer filtering coefficients (cf. signal W). The stored beamformer filtering coefficients may comprise a first set of complex frequency dependent weighting parameters $w_{11}(k)$, $w_{12}(k)$ representing the first beam former ($C_1$), and a second set of complex frequency dependent weighting parameters $w_{21}(k)$, $w_{22}(k)$ representing a second beam former ($C_2$), as discussed in connection with FIGS. 2 and 4 above (k representing a frequency index). The first and second sets of weighting parameters $w_{11}(k)$, $w_{12}(k)$ and $w_{21}(k)$, $w_{22}(k)$, respectively, may be predetermined, e.g. used as initial values. In an embodiment, the hearing device (e.g. the control unit CONT) is configured to adaptively update one or more of the weighting parameters $w_{11}(k)$, $w_{12}(k)$ and $w_{21}(k)$, $w_{22}(k)$ stored in the memory during operation of the hearing device.

Further, the control unit (CONT) may comprises a mode input for selecting a particular mode of operation of the hearing device. Such mode may be selectable via a user interface and/or be automatically determined from a number of detector inputs (e.g. from a classifier of the acoustic environment, e.g. comprising one or more of an auto-correlation detector, a cross-correlation detector, a feedback detector, a voice detector, a tone detector, a feedback change detector, an audibility detector, etc.). The mode input may influence or form basis of control output(s) A1ctr, A1ctr, HAGctr from the control unit for controlling the adaptive algorithms of the feedback estimation unit and processing of the processor HLC. One mode of operation may be a communication mode, where the user's own voice is picked by a dedicated own voice beamformer and transmitted to another device, e.g. a telephone or hearing device worn by another person. Such own voice pickup may be performed instead of or in parallel to a normal operation of the beamformer filtering unit where the first and second microphones pick up sound from the environment (other than the user's own voice).

The hearing device (HD) further comprises processor (HLC) for executing one or more processing algorithms (e.g. compressive amplification), e.g. to provide a frequency dependent gain and/or a level dependent compression and/or a transposition of one or more frequency ranges to one or more other frequency ranges, e.g. to compensate for a hearing impairment of a user. In the embodiment of FIG. 6, the processor (HLC) receives the spatially filtered (beamformed) signal $Y_{BF}$ and provides a processed signal $Y_G$, which is fed to a synthesis filter bank (FB-S) for converting the signal $Y_G$ processed in a number (K, K being e.g. 16 or 64 or more) of frequency sub-bands to a processed time domain signal OUT, which is fed to the output transducer (here loudspeaker SP) (which may comprise appropriate digital to analogue conversion circuitry).

In the embodiment of FIG. 6, signal processing in the analysis path (feedback estimation, etc.) is performed in the time domain. It may, however, be performed fully or partially in the frequency domain, depending on the particular application in question. In the embodiment of FIG. 6, signal processing in the forward path is performed partially in the time domain (feedback correction) and partially in the frequency domain (beamforming and hearing loss compensation).

Figure 7B:
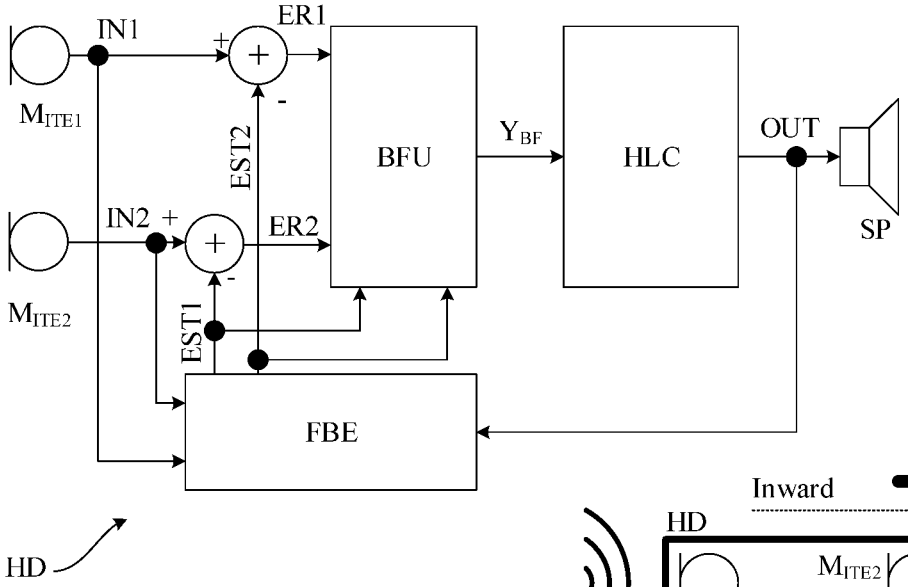
FIG. 7B shows a schematic block diagram of an embodiment of a hearing device as shown in FIG. 7A.

The hearing device of FIG. 6 is an embodiment of the slightly more general embodiment of a hearing device illustrated in FIG. 7B.

Figure 7A:
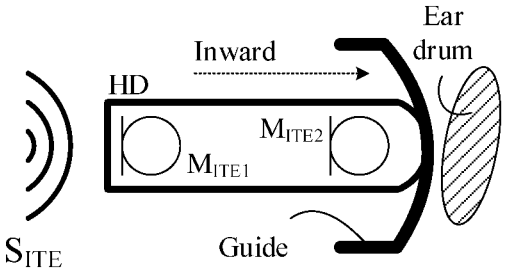
FIG. 7A shows an embodiment of a hearing device comprising two microphones located in an ITE-part according to the present disclosure.

FIG. 7A shows an embodiment of a hearing device (HD) comprising two microphones ($M_{ITE1}$, $M_{ITE2}$) located in an ITE-part according to the present disclosure. The ITE-part comprises a housing, wherein the two ITE-microphones ($M_{ITE1}$, $M_{ITE2}$) are located (e.g. in a longitudinal direction of the housing along an axis of the ear canal (cf. dotted arrow 'Inward' in FIG. 7A), when the hearing device (HD) is operationally mounted on or at the user's ear. The ITE-part further comprises a guiding element ('Guide' in FIG. 7A) configured to guide the ITE-part in the ear canal during mounting and use of the hearing device (HD). The ITE-part further comprises a loudspeaker (facing the ear drum) for playing a resulting audio signal to the user, whereby a sound field is generated in the residual volume. A fraction thereof is leaked back towards the ITE-microphones ($M_{ITE1}$, $M_{ITE2}$) and the environment. The hearing device (e.g. the ITE-part, which may constitute a part customized to the ear or the user, e.g. in form, or alternatively have a standardized form) comprises the various functional blocks of the hearing device (BFU, HLC, FBE). FIG. 7B shows a schematic block diagram of an embodiment of a hearing device as shown in FIG. 7A. The loudspeaker (SP), the beamformer filtering unit (BFU), the processor (HLC) and the feedback estimation unit (FBE) have the function described in connection with the embodiment of FIG. 6. The hearing device (HD) may be configured to be located in the soft part of the ear canal of the user. In an embodiment, the hearing device (HD) is configured to be located fully or partially in the bony part of the ear canal.

Figure 7D:
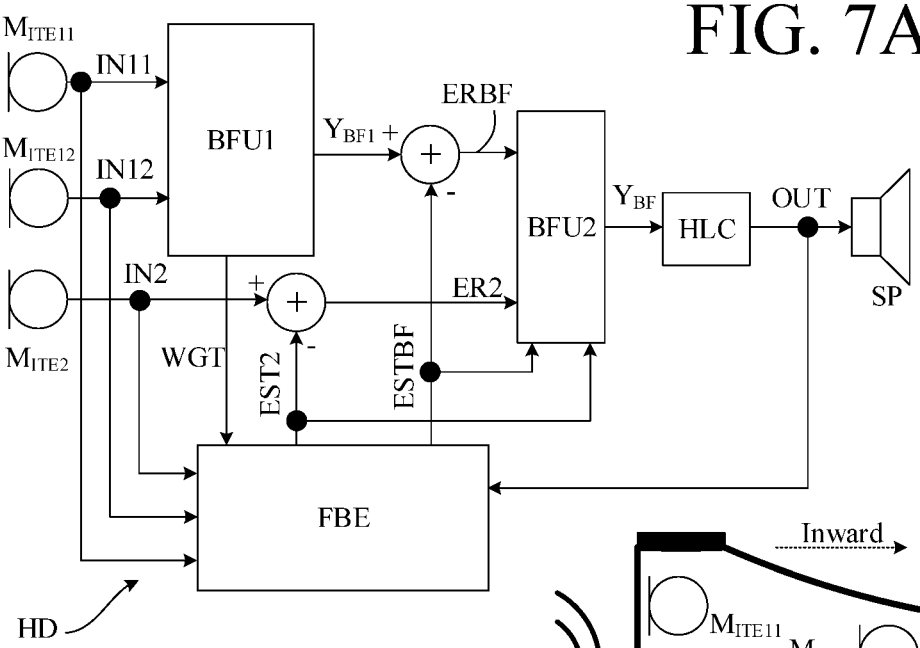
FIG. 7D shows a schematic block diagram of an embodiment of a hearing device as shown in FIG. 7C.
Figure 7C:
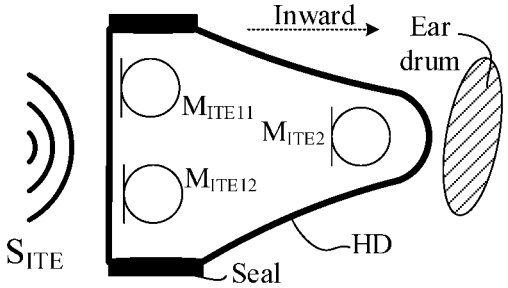
FIG. 7C shows an embodiment of a hearing device comprising three microphones located in an ITE-part according to the present disclosure.

FIG. 7C shows an embodiment of a hearing device comprising three microphones located in an ITE-part according to the present disclosure. FIG. 7D shows a schematic block diagram of an embodiment of a hearing device as shown in FIG. 7C. The embodiment of a hearing device (HD) of FIGS. 7C and 7D comprises three microphones ($M_{ITE11}$, $M_{ITE12}$, $M_{ITE2}$) in an ITE-part. Two of the microphones ($M_{ITE11}$, $M_{ITE12}$) face the environment, and one microphone ($M_{ITE2}$) faces the ear drum (when the hearing device is operationally mounted). The hearing device comprising, or being constituted by, an ITE-part comprising a sealing element for providing a tight seal (cf. 'seal' in FIG. 7C) towards the walls of the ear canal to acoustically 'isolate' the ear drum facing microphone ($M_{ITE2}$) from the environment sound ($S_{ITE}$) impinging on the ear canal (and hearing device), cf. FIG. 7C. The hearing device (HD) comprises the same functional elements as the embodiment of FIGS. 8A and 8B. The embodiment of FIG. 7D additionally comprises respective feedback cancellation systems (comprising combination units '+' for subtracting the feedback estimates ESTBF and EST2 of the beamformed signal $Y_{BF}$ and the ear drum-facing microphone signal IN2, respectively. The environment facing microphone signals IN11, IN12 are fed to a first beamformer unit BFU1 providing a first (far-field) beamformed signal $Y_{BF1}$. An estimate ESTBF of the feedback path for this 'directional microphone' (represented by the front facing microphones ($M_{ITE11}$, $M_{ITE12}$) and the first beamformer unit BFU1) is subtracted from the first (far-field) beamformed signal $Y_{BF1}$ providing feedback corrected beamformed signal ERBF, which is fed to a second beamformer unit (BFU2). The signal IN2 from the ear drum facing microphone ($M_{ITE2}$) is connected to combination unit '+', where an estimate of the feedback path from the loudspeaker (SP) to the ear drum facing microphone ($M_{ITE2}$) is subtracted, which provides a feedback corrected ear drum facing microphone signal ER2. This signal is fed to the second beamformer unit (BFU2), which provides a resulting far-field and feedback minimized, beamformed signal $Y_{BF}$. Based on the input signals (ERBF, ER2) and the feedback estimates (ESTBF, EST2). The resulting beamformed signal $Y_{BF}$ is (or may be) subject to one or more processing algorithms (e.g. compressive amplification to compensate for a hearing impairment of the user) in processor (HLC). The resulting processed signal OUT is fed to the output transducer (loudspeaker SP) and played to the user as a sound signal. The resulting processed signal OUT is also fed to the feedback estimation unit (FBE) as a reference signal.

Figure 7E:
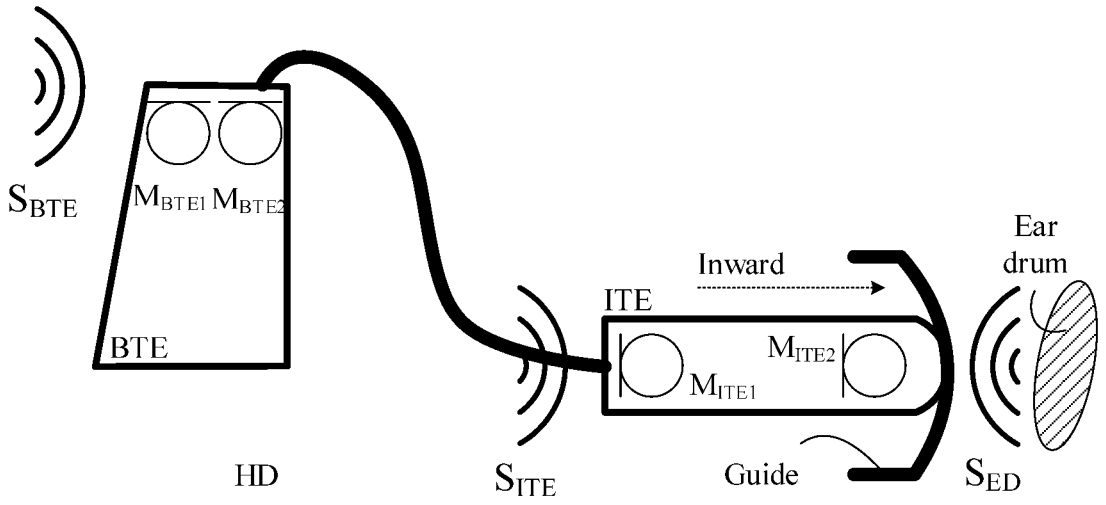
FIG. 7E shows an embodiment of a hearing device comprising four microphones, two located in a BTE part and two located in an ITE-part according to the present disclosure.

FIG. 7E shows an embodiment of a hearing device (HD) comprising four microphones, two ($M_{BTE1}$, $M_{BTE2}$) located in a BTE part (BTE) and two ($M_{ITE1}$, $M_{ITE2}$) located in an ITE-part (ITE) according to the present disclosure. The BTE-part is adapted to be located at or behind an ear (pinna) and the BTE-part is adapted to be located at or in an ear canal (of the same ear) of the user. The BTE-part and the ITE part are electrically connected (by wire or wirelessly). The ITE-part comprises a housing, wherein the two ITE-microphones ($M_{ITE1}$, $M_{ITE2}$) are located (e.g. in a longitudinal direction of the housing along an axis of the ear canal (cf. dotted arrow 'Inward' in FIG. 7E), when the hearing device (HD) is operationally mounted on or at the user's ear. The ITE-part further comprises a guiding element ('Guide' in FIG. 7E) configured to guide the ITE-part in the ear canal during mounting and use of the hearing device. The ITE-part further comprises a loudspeaker (facing the ear drum) for playing a resulting audio signal to the user, whereby a sound field SED is generated in the residual volume. A fraction thereof is leaked back towards the ITE-microphones ($M_{ITE1}$, $M_{ITE2}$) and the environment. The BTE-part comprises a housing wherein the two BTE-microphones ($M_{BTE1}$, $M_{BTE2}$) are located (e.g. in a top part of the housing so that they lie in a horizontal plane when mounted correctly at the user's ear (so that the microphone axis is parallel to a look direction of the user, cf. FIG. 7E).

Figure 7F:
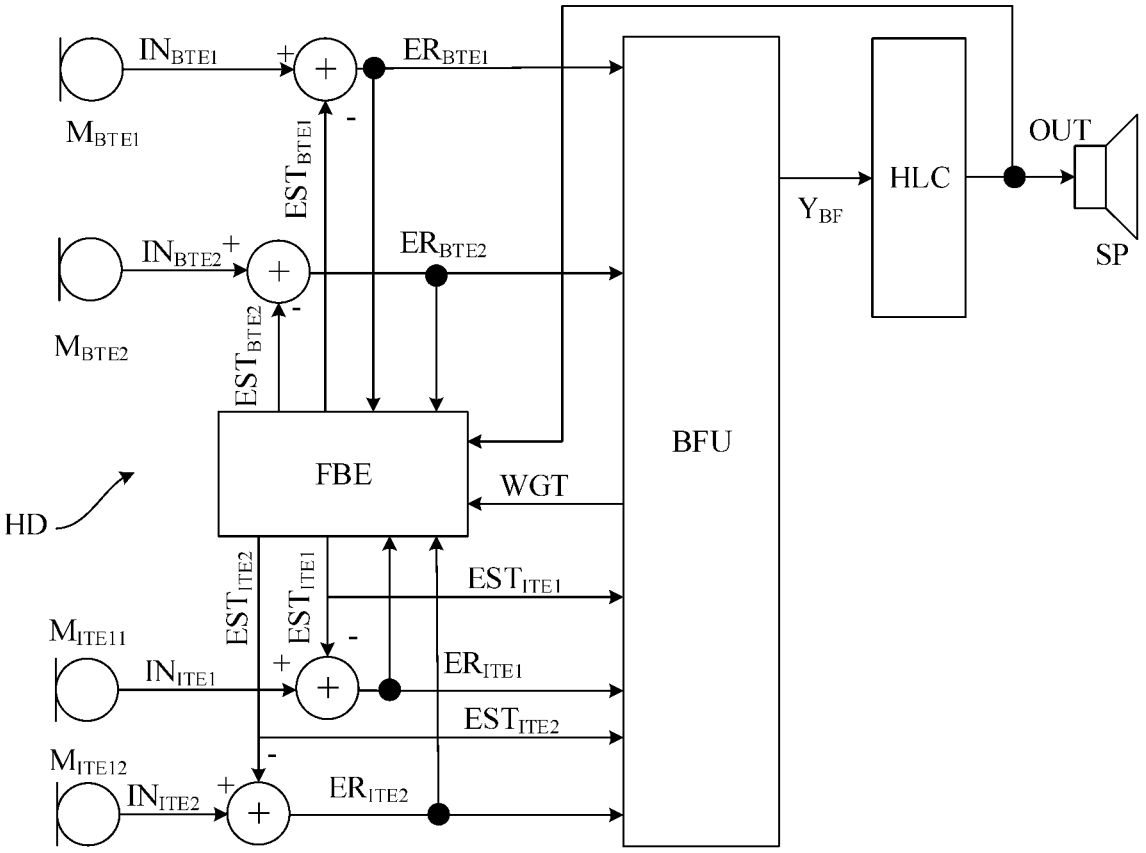
FIG. 7F shows a schematic block diagram of an embodiment of a hearing device as shown in FIG. 7E.

FIG. 7F shows a schematic block diagram of an embodiment of a hearing device as shown in FIG. 7E. The hearing device (e.g. the BTE-part and/or the ITE part) comprises processing units (cf. units FBE, BFU, HLC, in FIG. 7F) configured to process the microphone signals according to the present disclosure, including to estimate and minimize feedback from the loudspeaker (SP) to the microphones, and (at least in a certain mode of operation) to apply relevant beamforming to the microphone signals. The hearing device further comprises a processor (HLC) for applying relevant processing algorithms to the (possibly) beamformed signal $Y_{BF}$. The processed signal OUT from the processor (HLC) is fed to the loudspeaker (SP) for presentation to the user, and to the feedback estimation unit (FBE) as a reference signal.

As shown in FIG. 7F, the ITE-microphones ($M_{ITE1}$, $M_{ITE2}$) receive a sound field $S_{ITE}$ comprising feedback from the nearby loudspeaker, and provides ITE-microphones signals ($IN_{ITE1}$, $IN_{ITE2}$), which are fed to respective combination units ('+') where respective feedback estimates ($EST_{ITE1}$, $EST_{ITE2}$), are subtracted to provide feedback corrected ITE-microphone signals ($ER_{ITE1}$, $ER_{ITE2}$). The (feedback corrected) microphone signals from the ITE-microphones are used in the beamformer filtering unit (BFU) for providing one or more beamformers for use in cancelling or minimizing feedback in the resulting beamformed signal $Y_{BF}$.

As shown in FIG. 7F, the BTE-microphones ($M_{BTE1}$, $M_{BTE2}$) receive a sound field $S_{BTE}$, comprising less feedback than the ITE-microphones, and provides BTE-microphones signals ($IN_{BTE1}$, $IN_{BTE2}$), which are fed to respective combination units ('+') where respective feedback estimates ($EST_{BTE1}$, $EST_{BTE2}$), are subtracted to provide feedback corrected BTE-microphone signals ($ER_{BTE1}$, $ER_{BTE2}$). The (feedback corrected) BTE-microphone signals ($IN_{BTE1}$, $IN_{BTE2}$) from the BTE-microphones are used in the beamformer filtering unit (BFU) for providing one or more beamformers directed towards the environment (e.g. a nearby speaker, or the user's mouth).

The feedback estimation unit (FBE) is configured to provide respective estimates ($EST_{BTE1}$, $EST_{BTE2}$, $EST_{ITE1}$, $EST_{ITE2}$) of the feedback paths from the loudspeaker (SP) to each of the four microphones ($M_{BTE1}$, $M_{BTE2}$, $M_{ITE1}$, $M_{ITE2}$). The feedback estimates are based on the respective feedback corrected input signals ($ER_{BTE1}$, $ER_{BTE2}$, $ER_{ITE1}$, $ER_{ITE2}$), the processed output signal (OUT) and possibly on applied weights (WGT) in the beamformer filtering unit (BFU), cf. e.g. discussion in connection with FIG. 8.

In general, microphones located in the BTE-part are good at extracting environmental noise from the background, whereas microphones located in the ITE-part are good at extracting feedback. In an embodiment, the hearing device of FIG. 5, or 7E, F may be configured to use the BTE microphones (e.g. $M_{BTE1}$, $M_{BTE2}$ in FIGS. 7E, 7F) for estimate post-filter gains for reducing noise in a beamformer, e.g. a target cancelling beamformer based on the BTE-microphone signals (e.g. $IN_{BTE1}$, $IN_{BTE2}$ in FIG. 7F). The post-filter gains may e.g. be applied to a signal of the forward path of the hearing device, where the signal of the forward path is based on a feedback cancelling beamformer based on the two BTE-microphone signals (e.g. $IN_{BTE1}$, $IN_{BTE2}$ in FIG. 7F), or based on the ITE-microphone signals BTE-microphone signals (e.g. $IN_{ITE1}$, $IN_{ITE2}$ in FIG. 7F), or a combination of BTE- and ITE-microphone signals. Such configuration is further discussed in connection with FIGS. 9A, 9B, 9C.

The embodiments of FIGS. 7A, 7C and 7E may be representative of processing in the time-domain, but may alternatively comprise respective filter banks to provide processing in the (time-)frequency domain (e.g. based on Short Time Fourier Transform (STFT)), cf. e.g. embodiments of FIG. 6, and FIGS. 9A, 9B, 9C, comprising respective analysis and synthesis filter banks).

An Example:

In the previous examples, two microphones have been included oriented along an axis going from the outer ear opening and into the ear canal towards the eardrum. The signals from this microphone pair is subjected to a beamformer which is adjusted to process far field sounds originating from outside the ear as in a single omnidirectional microphone system and at the same time suppress the feedback signal (which is generated in the near field) received through the directional microphone system. Hence, in this way exceptionally high feedback suppression is possible while receiving the far field sounds from the surroundings in much the same way as in a single microphone hearing instrument.

Hence, the present disclosure, utilizes the additional anti-feedback performance which may be obtained from spatial signal separation as described for a two-microphone system in connection with FIGS. 1-4, 6 above. In the following further embodiment, these principles are applied in a system with three microphones, two of which represent a conventional directional system as described above and where the third microphone is added for the purpose of spatial feedback suppression.

Figure 8A:
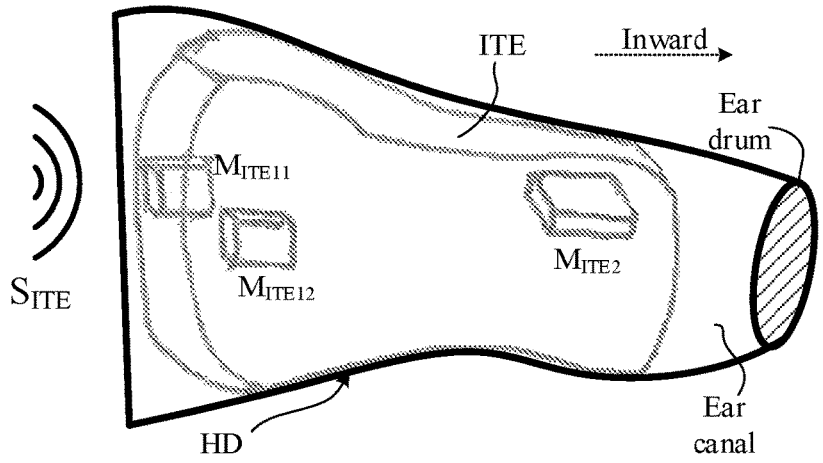
FIG. 8A shows an embodiment of a hearing device comprising three microphones located in an ITE-part according to the present disclosure.

FIG. 8A shows an embodiment of a hearing device comprising three microphones located in an ITE-part according to the present disclosure.

Figure 8B:
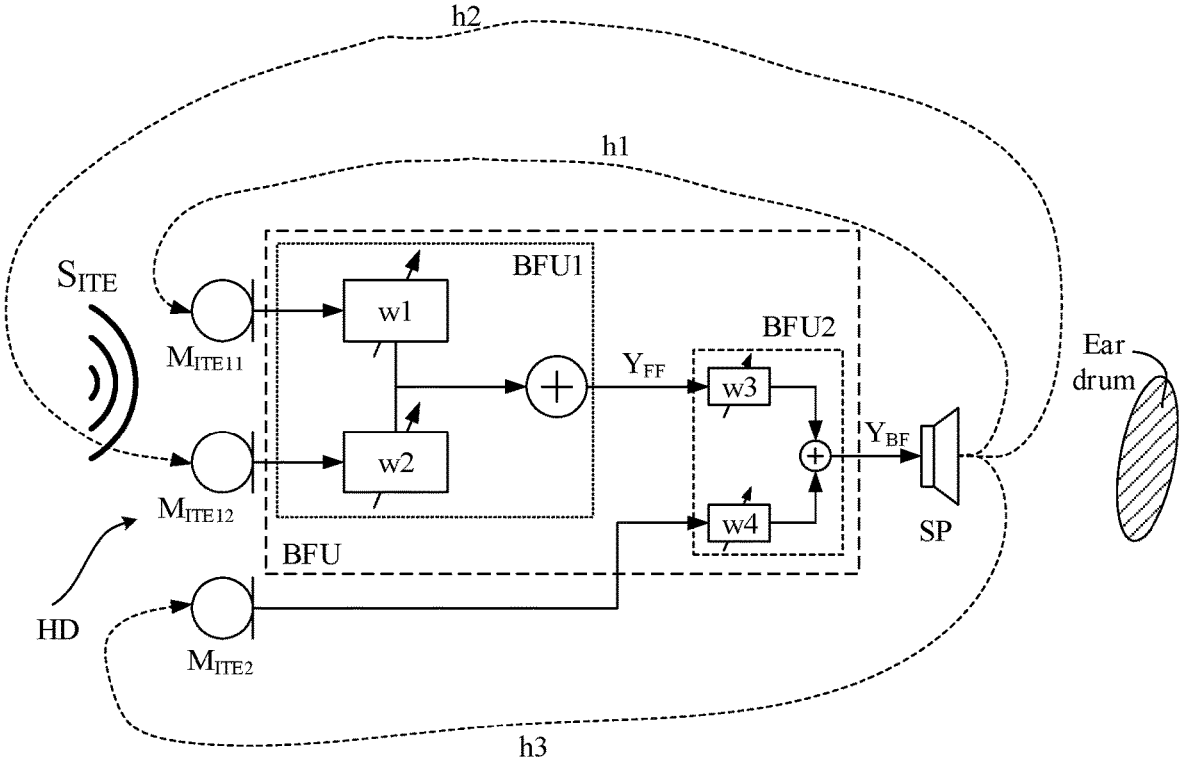
FIG. 8B shows a schematic block diagram of an embodiment of a hearing device as shown in FIG. 8A.

FIG. 8B shows a schematic block diagram of an embodiment of a hearing device as shown in FIG. 8A.

The proposed hearing instrument configuration is sketched in FIG. 8A. The hearing device (HD) comprises an ITE-part (ITE) comprising three input transducers, here microphones. The 'outer microphones' ($M_{ITE11}$, $M_{ITE12}$), located (e.g. in a housing of the ITE-part) to face the environment, e.g. at an opening of the ear canal ('Ear canal'), provide directional information in order to enhance speech intelligibility of a target signal (and may contribute to reduction of noise from the environment). The inner microphone ($M_{ITE2}$, located closest to the ear drum (cf. hatched ellipse denoted 'Ear drum', and dotted arrow denoted 'Inward' indicating a direction towards the inner ear/ear drum)) serves as a means of getting spatial anti-feedback information for increased audiological performance in terms of acoustic amplification. Preferably the ITE part comprises a seal towards the walls or the ear canal so that the ITE part fits tightly to the walls ear canal (or at least provides a controlled or minimal leakage channel for sound). The ITE-part may comprise a vent to minimize the occlusion effect. A purpose of the seal may further be to minimize environment noise in the sound field reaching the inner microphone ($M_{ITE2}$), to avoid (re-)introducing environmental noise in the beamformed signal when the signal from the inner microphone ($M_{ITE2}$) is combined with the signals of the outer microphones ($M_{ITE11}$, $M_{ITE12}$, cf. e.g. FIG. 8B).

The spatial anti-feedback performance may be implemented as one spatial feedback system cf. beamformer filtering unit (dashed outline denoted BFU in FIG. 8B) consisting of the inner microphone ($M_{ITE2}$) and the outer microphone pair ($M_{ITE11}$, $M_{ITE12}$) treated as one microphone (cf. signal $Y_{FF}$ in FIG. 8B). In this implementation the output signals from the two outer microphones may be averaged as a means of obtaining spatial anti-feedback for both microphones using only one anti-feedback system. Alternatively, the performance is further enhanced by the use of two separately optimised spatial anti-feedback systems. In this implementation, two sets of optimizations are done—one for microphones $M_{ITE11}$ and $M_{ITE2}$, (see FIG. 8A) and one for microphones $M_{ITE12}$ and $M_{ITE2}$.

If we regard the outer microphones ($M_{ITE11}$, $M_{ITE12}$) as a single microphone unit, we assume that the microphone system has one joint feedback path. If, however we have an adaptive microphone system, the resulting joint feedback path will change depending on the directional weights. If we know an estimate of the two outer acoustical feedback paths (h1, h2 (impulse response) or H1, H2 (frequency response)) as well as the directional weights (w1, w2), we can calculate the joint outer feedback path, which we then can use to adapt the directional pattern in connection with the feedback path of the inner microphone (as explained in the following).

In case the beamformer filtering unit (BFU) represents an adaptive directional system, the joint feedback path of the two external ITE microphones ($M_{ITE11}$, $M_{ITE12}$), will change depending on the adaptive directional system. h1 and h2 are the impulse responses of the acoustic feedback path, and w1 and w2 are the adaptive weights of the directional system (BFU1, may as well be realized in the frequency domain).

As the joint adaptive system is given by w1*h1+w2*h2, the (joint) feedback path may change solely depending on the adaptive parameters of the directional system (even though h1 and h2 are kept constant).

The adaptive weights (or impulse responses) of the directional feedback cancellation system (w3 and w4) shall thus be adapted according to this change, and may thus depend on w1, w2 as well as (fixed or adaptive) estimates of the feedback paths (h1, h2 and h3).

Figure 9A:
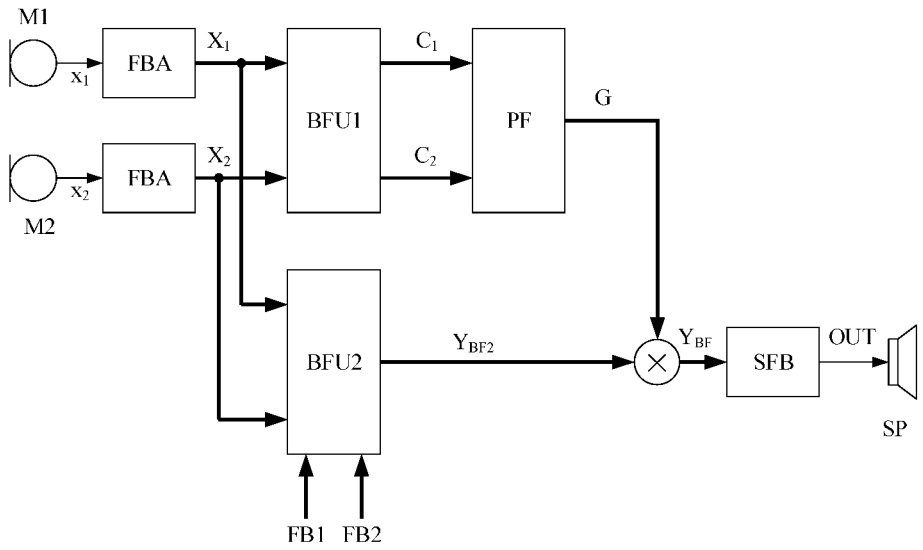
FIG. 9A shows a first embodiment of a hearing device comprising two input transducers (e.g. microphones) used for cancelling noise in the environment as well as feedback from the output transducer (e.g. a loudspeaker) to the input transducers (microphones)
Figure 9B:
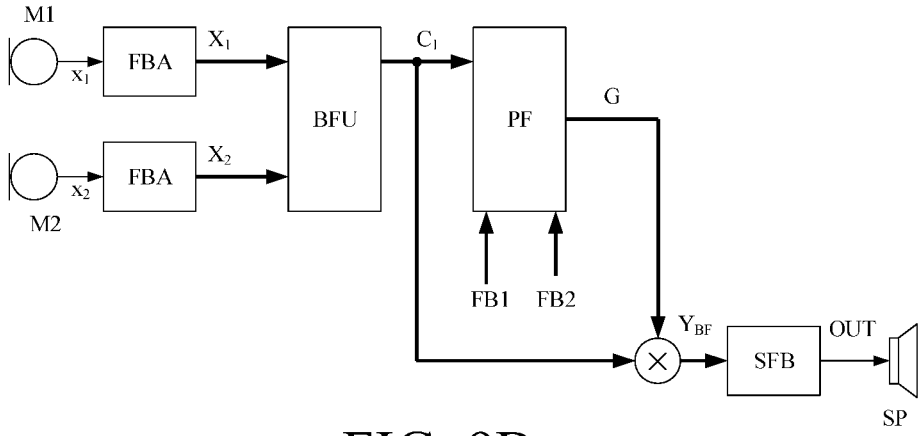
FIG. 9B shows a second embodiment of a hearing device comprising two input transducers used for cancelling noise in the environment as well as feedback from the output transducer to the input transducers.
Figure 9C:
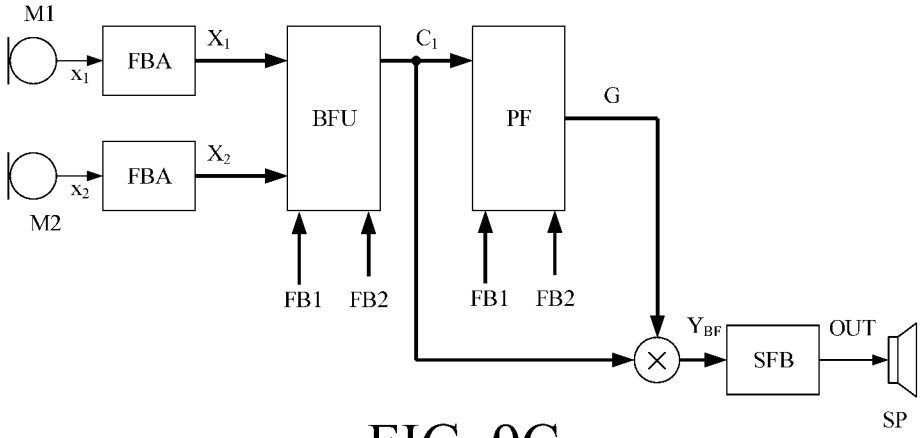
FIG. 9C shows a third embodiment of a hearing device comprising two input transducers used for cancelling noise in the environment as well as feedback from the output transducer to the input transducers.

FIGS. 9A, 9B, 9C illustrates three different embodiments of hearing devices according to the present disclosure. Each of the hearing devices (HD) comprises two input transducers (here microphones M1, M2) used for cancelling noise in the environment as well as feedback from an output transducer (e.g. as here a loudspeaker SP) to the input transducers (M1, M2) according to an aspect of the present disclosure. The embodiments of FIGS. 9A, 9B, 9C each comprises a microphone array comprising at least two microphones (M1, M2) positioned in a way such that the microphone array can be used to cancel external noise as well as feedback. The at least two microphones may e.g. comprise two BTE microphones (e.g. arranged as $M_{BTE1}$, $M_{BTE2}$ in FIG. 7E), or two ITE microphones (e.g. arranged as $M_{ITE11}$, $M_{ITE12}$ in FIG. 7C), or two BTE microphones (e.g. arranged as $M_{BTE1}$, $M_{BTE2}$ in FIG. 7E) and one ITE microphone (e.g. arranged as $M_{ITE}$ in FIG. 5, or as $M_{ITE2}$ in FIG. 7C), or three ITE microphones (e.g. as illustrated in FIG. 7C).

FIG. 9A shows a first embodiment of a hearing device (HD) comprising two microphones (M1, M2) used for cancelling noise in the environment as well as feedback from a loudspeaker (SP) to the microphones (M1, M2). The microphone signals ($x_1$, $x_2$) are propagated through respective analysis filter banks (FBA) in order to obtain a frequency domain representation ($X_1$, $X_2$) of the two microphone signals. The frequency-domain microphone signals are processed in two beamformer units (BFU1 and BFU2). The first beamformer unit has two output signals—$C_1$, which (possibly adaptively) enhances a target sound from a given direction, and a target cancelling beamformer $C_2$ which cancels the sound from a given target direction. The two directional signals are propagated into a post filter block (PF) used to estimate a signal to noise ratio, which is converted into a gain (G), which varies across time and frequency (G=G(k,m), where k and m are frequency and time indices, respectively, cf. e.g. EP2701145A1). The gain is multiplied to the output $Y_{BF2}$ of the other beamforming unit (BFU2), which creates a (possibly adaptive) directional signal $Y_{BF}$ aiming at cancelling the feedback as well as noise in the environment. The resulting signal is converted back into a time domain signal OUT by use of a synthesis filter bank (AFS), and presented to the listener. Hereby, the post filter gain aims at removing external noise while the directional signal aims at removing feedback.

FIG. 9B shows a second embodiment of a hearing device (HD) comprising two input transducers (M1, M2) used for cancelling noise in the environment as well as feedback from the output transducer (SP) to the input transducers (M1, M2). The embodiment of FIG. 9B resembles the embodiment of FIG. 9A, but is different in that it only comprises one beamformer unit (BFU) receiving the electric (frequency sub-band) input signals ($X_1$, $X_2$) from the microphones. The beamformer unit (BFU) provides beamformer $C_1$, which (possibly adaptively) enhances a target sound from a given direction. The post filter (PF) converts the xx to a gain G, while attenuating 'noise' from the feedback paths. The resulting gains G are applied to the target signal $C_1$ (cf. multiplication unit '×') thereby providing the resulting beamformed signal which is converted to the time domain (signal OUT) in synthesis filter bank (SFB) and fed to the loudspeaker (SP) for presentation to the ear drum of the user. The directional signal $C_1$ aims at removing noise in the external sound and the post filter gain G aims at removing the feedback signal. In that case, the noise estimate could be the feedback signals (cf. input signals FB1, FB2 to the post filter (FP)) (either a single feedback estimate, or a combination (e.g. a MAX value), rather than the target cancelling beamformer ($C_2$, as in FIG. 9A)).

FIG. 9C shows a third embodiment of a hearing device (HD) comprising two input transducers (M1, M2) used for cancelling noise in the environment as well as feedback from the output transducer (SP) to the input transducers (M1, M2). The embodiment of FIG. 9C is equal to the embodiment of FIG. 9B apart from the beamformer unit (BFU) in FIG. 9C being updated by respective feedback path estimates (FB1, FB2) from the loudspeaker SP to the microphones (M1, M2). In the embodiment of FIG. 9C, the directional system (BFU) as well as the post filter (PF) are adapted in order to minimize feedback (cf. input signals (FB1, FB2)).

In the embodiments of a hearing device in FIGS. 9A, 9B, 9C, the spatially filtered (beamformed) and noise reduced signal $Y_{BF}$ is presented to the user. It may of course be subject to other processing algorithms (e.g. compressive amplification to compensate for a hearing loss of the user) before presented to the user (cf. e.g. processor HLC in FIG. 6, or FIGS. 7B, 7D, 7F).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but one or more intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2843971A1 (OTICON) Apr. 3, 2015
EP2701145A1 (RETUNE DSP, OTICON) 26 Feb. 2014
EP3253075A1 (OTICON) Jun. 12, 2017

The invention claimed is:

1. A hearing device, e.g. a hearing aid, configured to be located at or in an ear, or to be fully or partially implanted in the head at an ear, of a user, the hearing device comprising a multitude of input transducers for providing respective electric input signals representing sound in an environment of the user, wherein the hearing device is configured to provide each of said respective electric input signals in a time-frequency representation (k,m) as frequency sub-band signals $X_i(k,m)$, i=1, . . . , M, where M is the number of input transducers, where k and m are frequency and time indices, respectively, and where k=1, . . . , K;

an output transducer for providing stimuli perceivable to the user as sound based on said electric input signals or a processed version thereof;

an adaptive beamformer filtering unit connected to said multitude of input transducers and to said output transducer, and configured to provide a spatially filtered signal based on said multitude of electric input signals and adaptively updated beamformer weights;

a feedback estimation unit providing feedback estimates of current feedback paths from said output transducer to each of said input transducers;

wherein at least one of said adaptively updated beamformer weights of the adaptive beamformer filtering unit is/are updated in dependence of said feedback path estimates, and wherein the adaptive beamformer filtering unit comprises a first set of two beamformers:

a) a first beamformer $C_1$ which is configured to leave a signal from a target direction substantially un-altered, and b) a second beamformer $C_2$ which is configured to substantially cancel the signal from the target direction, and wherein the adaptive beamformer filtering unit is configured to provide a resulting directional signal $Y(k)=C_1(k)-\beta(k)C_2(k)$, where $\beta(k)$ is an adaptively updated adaptation factor defining said adaptively updated beamformer weights where $\beta(k)$ is determined based on said feedback path estimates.

2. The hearing device according to claim 1 configured to provide that said adaptation factor $\beta(k)$ is determined from the following expression $$\beta(k) = \frac{\langle C_{F2}^{*} C_{F1} \rangle}{\langle |C_{F2}|^2 \rangle + c}$$

where k is the frequency index, * denotes the complex conjugation and $\langle \bullet \rangle$ denotes the statistical expectation operator, and c is a constant, and where $(C_{F1}, C_{F2})$ constitute a second set of beamformers applied to said feedback path estimates in the frequency domain.

3. The hearing device according to claim 1 configured to provide that said adaptation factor $\beta(k)$ is determined from the following expression $$\beta = \frac{w_{C1}^{H} C_v w_{C2}}{w_{C2}^{H} C_v w_{C2}}$$

where $w_{C1}=(w_{11}(k), w_{12}(k))^T$ is a vector comprising a first set of complex frequency dependent weighting parameters representing said first beam former $(C_1)$, $w_{C2}=(w_{21}(k), w_{22}(k))^T$ is a vector comprising a second set of complex frequency dependent weighting parameters representing said second beam former $(C_2)$, and $C_v$ is a noise covariance matrix derived from said feedback estimates $(\hat{F}_1(k), \hat{F}_2(k))$ $$C_v = \langle [\hat{F}_1(k), \hat{F}_2(k)]^T [\hat{F}_1^{*}(k), \hat{F}_2^{*}(k)] \rangle$$

where T denotes transposition, * denotes complex conjugation, and $\langle \bullet \rangle$ denotes time average.

4. The hearing device according to claim 1 wherein said first set of two beamformers $(C_1, C_2)$ are fixed or adaptively determined.

5. The hearing device according to claim 4 wherein the second set of beamformers $(C_{F1}, C_{F2})$ are fixed or adaptively determined.

6. The hearing device according to claim 3 comprising a memory comprising a first set of complex frequency dependent weighting parameters $w_{11}(k)$, $w_{12}(k)$ representing said first beam former $(C_1)$, the memory comprising a second set of complex frequency dependent weighting parameters $w_{21}(k)$, $w_{22}(k)$ representing a second beam former $(C_2)$, where said first and second sets of weighting parameters $w_{11}(k)$, $w_{12}(k)$ and $w_{21}(k)$, $w_{22}(k)$, respectively, are predetermined.

7. The hearing device according to claim 2 wherein the second set of beamformers $(C_{F1}, C_{F2})$ have the same weights $((w_{11}, w_{12}), (w_{21}, w_{22}))$ as the first set of beamformers $(C_1, C_2)$, but are derived from the feedback path estimates $(\hat{F}_1, \hat{F}_2)$.

8. The hearing device according to claim 1 wherein a number of sets of predefined feedback path estimates corresponding to specific acoustic situations for each of said multitude of input transducers are stored in a memory of the hearing device.

9. The hearing device according to claim 1 comprising a detector of a current acoustic environment, the detector providing an environment detection signal indicative of a current feedback situation.

10. The hearing device according to claim 9 wherein a number of sets of predefined feedback path estimates corresponding to specific acoustic situations for each of said multitude of input transducers are stored in a memory of the hearing device, and the hearing device is configured to apply a relevant set of predefined feedback estimates to provide a set of beamformers $C_{F1}$, $C_{F2}$.

11. The hearing device according to claim 1 comprising a feedback suppression system for suppressing feedback from said output transducer to at least one of said input transducers.

12. The hearing device according to claim 1 consisting of or comprising a hearing aid, a headset, an ear protection device or a combination thereof.

13. The hearing device according to claim 1 comprising an ITE-part adapted for being located at or in an ear canal of the user, the ITE-part comprising a housing comprising a seal towards walls or the ear canal so that the ITE part fits tightly to the walls of the ear canal or at least provides a controlled or minimal leakage channel for sound, the ITE part comprising at least two microphones located outside the sealing facing the environment, and at least one microphone located inside the seal and facing the ear drum.

14. A hearing device configured to be located at or in an ear, or to be fully or partially implanted in the head at an ear, of a user, the hearing device comprising at least two input transducers for providing respective electric input signals;

an output transducer for providing stimuli perceivable to the user as sound based on said electric input signals or a processed version thereof;

a feedback estimation unit providing feedback estimate(s) of current feedback path(s) from said output transducer to at least one of said at least two input transducers;

a beamformer filtering unit connected to said at least two input transducers and to said output transducer, and configured to provide a spatially filtered signal based on said at least two electric input signals and appropriate beamformer weights;

a post filter connected to said beamformer filtering unit and configured to provide frequency and time dependent gains to be applied to said spatially filtered signal to thereby further reduce noise therein;

wherein said post filter is updated using said feedback estimate(s).

15. A hearing device configured to be located at or in an ear, or to be fully or partially implanted in the head at an ear, of a user, the hearing device comprising an ITE-part adapted for being located at or in an ear canal of the user, the ITE-part comprising a housing configured to be located at least partially in the ear canal of the user, at least three input transducers for providing respective electric input signals, wherein at least two input transducers facing the environment and providing respective electric input signals representing sound in an environment of the user, and at least one input transducer facing an ear drum and providing at least one electric input signal representing sound reflected from the ear drum, when the ITE-part is operationally mounted at or in the ear canal;

an output transducer for providing stimuli perceivable to the user as sound based on said electric input signals or a processed version thereof;

a beamformer filtering unit connected to said at least three input transducers and to said output transducer, and configured to provide a spatially filtered signal based on said at least three electric input signals and appropriate beamformer weights;

wherein said beamformer filtering unit comprises a first beamformer for spatial filtering said sound in the environment based on said electric input signals from said at least two input transducers facing the environment, and a second beamformer for spatial filtering sound reflected from the ear drum based on said at least one electric input signal from said at least one input transducer facing the ear drum and at least one of said electric input signals from said at least two input transducers facing the environment.

16. A method of suppressing feedback in a hearing device adapted for being located at or in an ear, or to be fully or partially implanted in the head at an ear, of a user, the hearing device comprising a multitude of input transducers and an output transducer connected to each other, the method comprising providing a multitude of electric input signals representing sound in an environment of the user in a time-frequency representation (k,m) as frequency sub-band signals $X_i(k,m)$, i=1, . . . , M, where M is the number of input transducers, where k and m are frequency and time indices, respectively, and where k=1, . . . , K;

providing stimuli perceivable to the user as sound based on said electric input signals or a processed version thereof;

providing a spatially filtered signal based on said multitude of electric input signals and adaptively updated beamformer weights;

providing feedback estimates of current feedback paths from said output transducer to each of said input transducers;

providing that at least one of said adaptively updated beamformer weights is/are updated in dependence of said feedback path estimates;

providing a first set of two beamformers:

a) a first beamformer $C_1$ which is configured to leave a signal from a target direction substantially un-altered, and b) a second beamformer $C_2$ which is configured to substantially cancel the signal from the target direction; and providing a resulting directional signal $Y(k)=C_1(k)-\beta(k)C_2(k)$, where $\beta(k)$ is an adaptively updated adaptation factor defining said adaptively updated beamformer weights where $\beta(k)$ is determined based on said feedback path estimates.

17. The method according to claim 16 comprising providing three or more electric input signals, wherein at least some of them are used for spatial filtering and reduction of noise in said sound in the environment, and wherein at least some of them are used for feedback cancellation, and where at least one of the electric input signals is used for both.

18. A non-transitory computer readable medium storing a computer program comprising instructions which, when the program is executed by a computer, cause the computer to carry out the method of claim 16.

19. The hearing device according to claim 6 where said first and second sets of weighting parameters w11(k), w12(k) and w21(k), w22(k), respectively, are predetermined, initial values, which are updated during operation of the hearing device.

20. The hearing device according to claim 15 configured to provide that said first and second beamformers are preferably simultaneously available.

21. The hearing device according to claim 15 wherein said output transducer comprises a loudspeaker configured to provide that said stimuli are directed towards the ear drum when the ITE part is operationally mounted in the ear canal.

22. The hearing device according to claim 15 wherein said housing comprises a seal towards walls or the ear canal so that the ITE part fits tightly to the walls of the ear canal or at least provides a controlled or minimal leakage channel for sound.

23. The hearing device according to claim 22 wherein said at least three input transducers comprises at least two microphones facing the environment and wherein said at least two microphones facing the environment and said at least one input transducer facing the ear drum are located on each side of said seal.

24. The hearing device according to claim 15 configured to provide said electric input signals in a time-frequency representation (k,m) as frequency sub-band signals Xi(k,m), i=1, . . . , M, where M is the number of input transducers, where k and m are frequency and time indices, respectively, and where k=1, . . . , K.

25. The hearing device according to claim 24 wherein beamformer weights for different frequency sub-bands are used for different purposes.

26. The hearing device according to claim 24 configured to provide that the beamformer filtering unit is used for feedback cancellation in frequency sub-bands, where feedback is dominant, while the beamformer filtering unit is used for noise reduction of external noise sources or microphone noise in frequency sub-bands, where feedback is not significant.

* * * * *